US012055333B2

(12) United States Patent
Song et al.

(10) Patent No.: US 12,055,333 B2
(45) Date of Patent: Aug. 6, 2024

(54) REFRIGERATOR WITH A THERMOELECTRICALLY POWERED RAPID FREEZE COMPARTMENT

(71) Applicant: LG Electronics Inc., Seoul (KR)

(72) Inventors: Seongmin Song, Seoul (KR); Yunsu Chu, Seoul (KR)

(73) Assignee: LG Electronics Inc., Seoul (KR)

( * ) Notice: Subject to any disclaimer, the term of this patent is extended or adjusted under 35 U.S.C. 154(b) by 387 days.

(21) Appl. No.: 17/441,779

(22) PCT Filed: Mar. 23, 2020

(86) PCT No.: PCT/KR2020/003933

§ 371 (c)(1),
(2) Date: Sep. 22, 2021

(87) PCT Pub. No.: WO2020/197212

PCT Pub. Date: Oct. 1, 2020

(65) Prior Publication Data

US 2022/0178606 A1 Jun. 9, 2022

(30) Foreign Application Priority Data

Mar. 22, 2019 (KR) ..... 10-2019-0033075
Aug. 28, 2019 (KR) ..... 10-2019-0105699

(51) Int. Cl.

| | |
|---|---|
| ***F25D 11/04*** | (2006.01) |
| ***F25D 11/02*** | (2006.01) |
| ***F25D 17/06*** | (2006.01) |
| ***F25D 25/02*** | (2006.01) |

(52) U.S. Cl.
CPC ..... *F25D 11/04* (2013.01); *F25D 11/025* (2013.01); *F25D 17/065* (2013.01); *F25D 25/025* (2013.01)

(58) Field of Classification Search
CPC ..... F25D 11/025; F25D 11/04; F25D 17/065; F25D 2317/061; F25D 2317/063; F25D 2317/0681; F25D 25/025; F25D 2317/067; F25B 21/04; F25B 2321/023; F25B 25/00;
(Continued)

(56) References Cited

U.S. PATENT DOCUMENTS

| | | | | |
|---|---|---|---|---|
| 9,109,819 | B2 * | 8/2015 | Shin | F25B 21/02 |
| 9,834,365 | B2 * | 12/2017 | Pointer | F25D 23/06 |
| 10,718,552 | B2 * | 7/2020 | Park | F25D 23/028 |

(Continued)

FOREIGN PATENT DOCUMENTS

| | | |
|---|---|---|
| JP | 2011202909 | 10/2011 |
| KR | 1020070042020 | 4/2007 |

(Continued)

*Primary Examiner* — Filip Zec
(74) *Attorney, Agent, or Firm* — Fish & Richardson P.C.

(57) ABSTRACT

The present invention relates to a refrigerator having a separate deep-freezing space which is partitioned inside a storage space of the refrigerator. Provided is a refrigerator having a flow path which allows cold air to circulate inside a deep-freezing chamber. According to an embodiment disclosed in the present document, a flow path portion is formed on one part of the inner surface of the housing which forms the inner space of the deep-freezing chamber. The flow path portion is formed in a stepped shape on the inner surface of the housing.

15 Claims, 19 Drawing Sheets

(58) Field of Classification Search
CPC .. F25B 41/20; F25B 5/02; F25B 21/02; F25B 2321/0251
See application file for complete search history.

(56) References Cited

U.S. PATENT DOCUMENTS

| | | | | |
|---|---|---|---|---|
| 11,060,769 | B2 * | 7/2021 | Oh | F25D 31/00 |
| 2012/0304667 | A1 * | 12/2012 | Shin | F25B 21/02 62/3.6 |
| 2015/0308721 | A1 * | 10/2015 | Shin | F25B 25/00 62/3.6 |
| 2016/0313046 | A1 * | 10/2016 | Roekens | F25D 25/02 |
| 2016/0377329 | A1 * | 12/2016 | Shin | F25D 11/025 62/3.6 |
| 2019/0049168 | A1 * | 2/2019 | Boarman | F25C 5/08 |
| 2019/0063817 | A1 * | 2/2019 | Kyriacou | F25B 21/02 |
| 2019/0162460 | A1 * | 5/2019 | Oh | F25B 21/02 |

FOREIGN PATENT DOCUMENTS

| | | |
|---|---|---|
| KR | 1020100057216 | 5/2010 |
| KR | 1020130049496 | 5/2013 |
| KR | 1020150024144 | 3/2015 |
| KR | 1020170084916 | 7/2017 |
| KR | 1020180045358 | 5/2018 |
| KR | 1020180080652 | 7/2018 |

* cited by examiner (a)

(b)

REFRIGERATOR WITH A THERMOELECTRICALLY POWERED RAPID FREEZE COMPARTMENT

CROSS-REFERENCE TO RELATED APPLICATIONS

This application is a National Stage application under 35 U.S.C. § 371 of International Application No. PCT/KR2020/003933, filed on Mar. 23, 2020, which claims the benefit of Korean Patent Application No. 10-2019-0033075, filed on Mar. 22, 2019 and Korean Patent Application No. 10-2019-0105699, filed on Aug. 28, 2019. The disclosures of the prior applications are incorporated by reference in their entirety.

TECHNICAL FIELD

The present disclosure relates to a refrigerator having a deep-freezing portion, and the present disclosure relates to a refrigerator having structural improvement for smooth flow of cold air introduced into the deep-freezing portion.

BACKGROUND ART

In general, a refrigerator is a home appliance to store food at a low temperature and includes a refrigerating space to store food in a refrigerated state at about 3° C. and a freezer space to store food in a frozen state at about −20° C.

However, when food such as meat or seafood is stored in the freezer space in the frozen state, moisture in cells of the meat or the seafood is discharged out of the cells while the food is frozen at −20° C. In this case, a cell destruction phenomenon occurs, and during defrosting, a texture change phenomenon occurs.

The temperature condition of the storage space is adjusted to be in a cryogenic state in which a temperature is significantly lower than a current temperature of the freezer space. So, when a state of the food is changed to a frozen state, the food passes through a freezing point temperature range, thereby minimizing the cell destruction. Therefore, there is an advantage in that the quality of meat and the texture of food may be returned to a state closer to a state before freezing even after defrosting. The cryogenic temperature may be understood as referring to a temperature within the range of −40 to −50° C.

For this reason, in recent years, the demand for a refrigerator defining a deep-freezing portion maintaining a temperature lower than that of the freezer space is increasing.

As there is a limitation to cooling using existing refrigerant, there has been an attempt to lower the temperature of the deep-freezing portion to a cryogenic temperature using a thermoelectric module (TEM) to satisfy the demand for the deep-freezing portion.

Related art patent document 1 (10-2013-0049496) discloses a refrigerator capable of maintaining a low storage temperature using a thermoelectric element. Related art patent document 2 (10-2010-0057216) discloses a refrigerator using a thermoelectric element for cooling of an ice-making room instead of using a cold air duct. Related art patent document 3 (10-2018-0045358) discloses a refrigerator to improve an area where heat is not sufficiently exchanged with a heat sink behind a hub of an axial fan. The related art patent documents do not disclose structural changes to the cold air flow inside a deep-freezing portion.

In order to maintain an inner temperature of the deep-freezing portion at a cryogenic temperature, the cold air supplied by a thermoelectric element module has to be circulated smoothly inside the deep-freezing portion and a flow path has to be provided to circulate the cold air. If the flow path is additionally defined in the deep-freezing portion, it is difficult to effectively use the storage space in the deep-freezing portion. Manufacturing thereof is difficult and durability thereof is degraded due to a complicated structure in the deep freezing portion.

RELATED ART DOCUMENT

Patent Document

Patent Document 1: 10-2013-0049496 (Published date: May 14, 2013)
Patent Document 2: 10-2010-0057216 (Published date: May 31, 2010)
Patent Document 3: 10-2018-0045358 (Published date: May 4, 2018)

DISCLOSURE

Technical Problem

Accordingly, one of various objects of the present disclosure is to provide a refrigerator defining a flow path on an inner surface of a deep-freezing portion to circulate cold air without defining an additional flow path inside the deep-freezing portion.

One of the various objects of the present invention describes a refrigerator in which a basket of the deep-freezing portion is connected to an inner surface of a door and a flow path for the circulation of cold air is defined in a gap between the deep-freezing portion basket and a bottom surface of the deep-freezing portion.

One of the various objects of the present invention describes a refrigerator capable of preventing the cold air supplied from and discharged to a rear surface of the deep-freezing portion from leaking to an outside of the deep-freezing portion when the deep-freezing portion is disposed inside the freezer space.

One of the various objects of the present invention describes a refrigerator in which a flow path is defined to expand an inner space of the deep-freezing portion.

Technical Solution

To address the various problems of the present disclosure, an exemplary embodiment of the present disclosure describes a refrigerator defining a stepped flow path in an inner surface of housing to provide a movement path of cold air.

An exemplary embodiment of the present disclosure describes a refrigerator in which a basket is coupled to a deep-freezing portion door at a height spaced apart from an inner bottom surface of the deep-freezing portion by a predetermined distance to provide a movement flow of cold air by a gap between the basket and the bottom surface thereof.

An exemplary embodiment of the present disclosure describes a refrigerator in which a flow path includes a bending portion and an inclined portion to smoothly discharge the cold air.

According to an exemplary embodiment of the present disclosure, a refrigerator includes a freezer space defining a storage space; and a deep-freezing portion disposed in the freezer space and defining a deep-freeze space that is partitioned from the storage space thereof a thermoelectric element module including a thermoelectric module having a heat absorbing surface and a heating surface and configured to generate cold air introduced into the deep-freezing portion; a fan facing the heat absorbing surface of the thermoelectric module and configured to introduce the cold air into the deep-freezing portion; and an accommodator configured to accommodate the fan and that protrudes from an inner surface of the freezer space, the deep-freezing portion includes housing having an opening at a front surface thereof and an opening at a rear surface thereof to receive the accommodator, and defining an inner space of the deep-freezing portion; a door configured to open and close the front surface of the housing; and the accommodator includes a guide disposed at one side of the accommodator and configured to guide flow of the cold air, the housing includes a flow path defined at a portion of an inner surface of the housing and the flow path has a step at the inner surface of the housing. In addition, the flow path may flow cold air introduced into the deep-freezing portion by the fan.

Preferably, the housing may define the flow path at a portion of an upper surface thereof and the flow path may expand the deep-freeze space in the housing. Specifically, the flow path has a recess shape, is concaved upward from the portion of the upper surface of the housing, and may expand the deep-freeze space.

The flow path may include vertical portions having a width of the flow path, that are spaced apart from each other, and extend in a longitudinal direction of the deep-freezing portion; and a horizontal portion connecting the vertical portions at a first side of the vertical portion.

In addition, the width of the flow path may be decreased along the longitudinal direction of the deep-freezing portion, a second side of the vertical portion may communicate with the guide, and a width of the vertical portion at the second side thereof may be the same as the guide.

The width of the flow path may be decreased along the longitudinal direction of the deep-freezing portion or may be maintained constantly in a certain section along the longitudinal direction of the deep-freezing portion and then may be decreased.

Meanwhile, the flow path may be inclined downward from an upper surface of the housing to a rear surface of the housing, the flow path may include a vertical portion having a width of the flow path, that are spaced apart from each other, and extend in a longitudinal direction of the deep-freezing portion; and a horizontal portion connecting the vertical portions at a first side of the vertical portion.

In addition, the flow path may further include a bending portion that extends in a direction of decreasing the width of the flow path at a second side of the vertical portion, the flow path may have inclination at the bending portion, and the bending portion may extend from the vertical portion to a position corresponding to a width of the guide.

Meanwhile, according to an exemplary embodiment of the present disclosure, a refrigerator includes a freezer space defining a storage space; a deep-freezing portion disposed in the freezer space and defining a deep-freeze space that is partitioned from the storage space thereof; a thermoelectric element module including a thermoelectric module having a heat absorbing surface and a heating surface and configured to generate cold air introduced into the deep-freezing portion; a fan facing the heat absorbing surface of the thermoelectric module and configured to introduce the cold air into the deep-freezing portion; and an accommodator configured to accommodate the fan and that protrudes from an inner surface of the freezer space, the deep-freezing portion includes: housing having an opening at a front surface thereof and an opening at a rear surface thereof to receive the accommodator, and defining an inner space of the deep-freezing portion; a door configured to open and close the front surface of the housing; and a basket coupled to the door and drawn out to an outside of the deep-freezing portion as the door opens and closes the front surface of the housing, the accommodator includes a guide disposed at one side of the accommodator and configured to guide flow of the cold air, and the housing includes a first flow path defining a step recessed from a portion of the inner surface of the housing; and a second flow path defined in a space between the portion of the inner surface of the housing and the basket. The first flow path and the second flow path flow cold air introduced into the deep-freezing portion by the fan.

Preferably, the first flow path may be defined at a portion of an upper surface of the housing, the second flow path may be defined in a space between a bottom surface of the housing and the basket, the first flow path may be defined in a direction of expanding the deep-freeze space in the housing, and the first flow path may include: a vertical portion having a width of the first flow path, that are spaced apart from each other, and extend in a longitudinal direction of the deep-freezing portion; a horizontal portion connecting the vertical portions at one side of the vertical portion; and a bending portion that extends from a second side of the vertical portion in a direction of decreasing the width of the first flow path.

In addition, the first flow path may further include an inclined portion that is inclined downward from a portion of an upper surface of the housing toward the rear surface of the housing and the inclined portion may be disposed in the first flow path along the bending portion.

Meanwhile, a height of the basket is smaller than a height of the housing and the basket may be coupled to an inner surface of the door at a position spaced apart from each of the upper surface and the lower surface of the housing by a predetermined distance, and a grill may be disposed on a surface facing the rear surface of the housing among surfaces of the basket.

In addition, the first flow path may communicate with the guide when the accommodator is inserted into the opening.

The guide includes an upper flow path that communicates with the first flow path, the upper flow path may have a guide inclined portion, and the guide inclined portion may be inclined downward from a lower surface of the upper flow path along a path through which the cold air moves.

Features of the above-described embodiments may be combined with other embodiments unless the features are contradictory or exclusive to other embodiments.

Advantageous Effects

According to the present disclosure, an inner space of a deep-freezing portion may be expanded and a flow path of cold air moving in the deep-freezing portion may be defined.

In addition, when the deep freezer portion is disposed in a refrigerator, the deep-freezing portion is coupled in a state in which a rear surface of the deep-freezing portion contacts an inside of the refrigerator and a flow path defined in the deep-freezing portion communicates with a grill fan assembly, thereby preventing leaking out of cold air.

In addition, the deep-freezing portion defines a step in an upper surface thereof to provide a flow path and a bottom surface thereof is spaced apart from a deep-freezing portion basket by a predetermined distance to define a flow path. As a component to define an additional flow path is not needed, there is an advantage in that a process is simplified, a storage space in a deep-freezing portion may be obtained, durability of the deep-freezing portion may be obtained, and maintenance may be facilitated.

Figure 5:
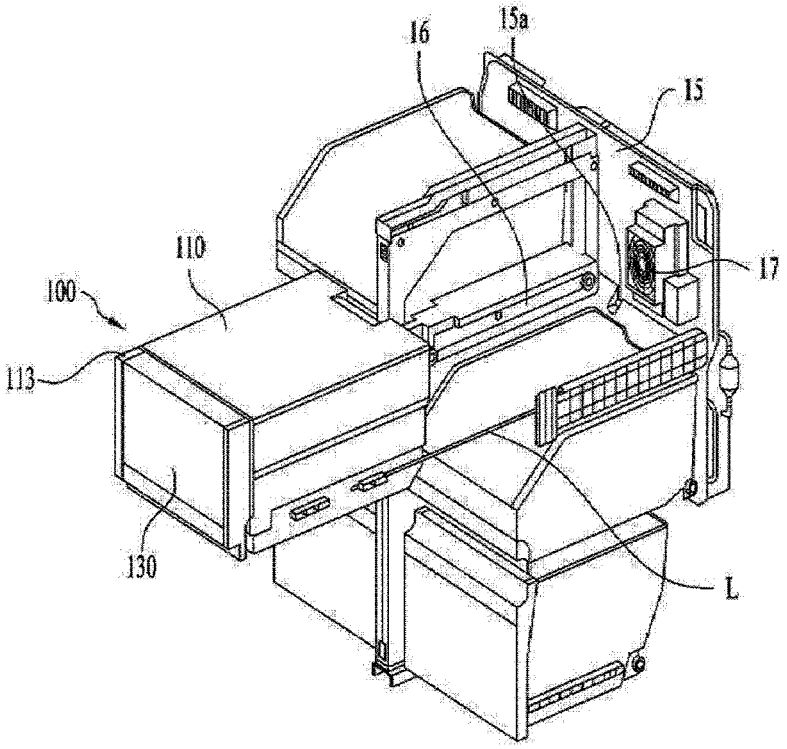
FIG. 5 shows a deep-freezing portion separated from a freezer space according to an embodiment of the present disclosure.
Figure 6:
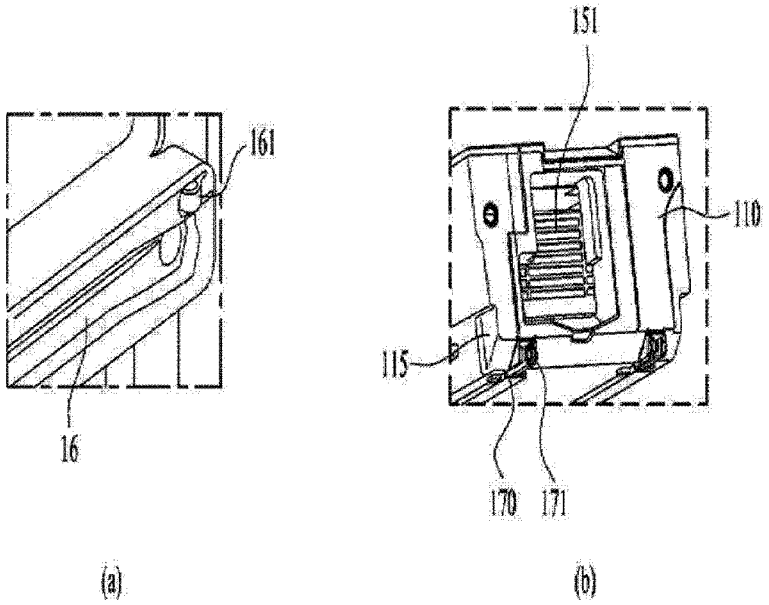

(a) of FIG. 6 is an enlarged view of a guide rail disposed on an inner wall of a freezer space. (b) of FIG. 6 is a rear view of the deep-freezing portion in FIG. 5.

Figure 7:
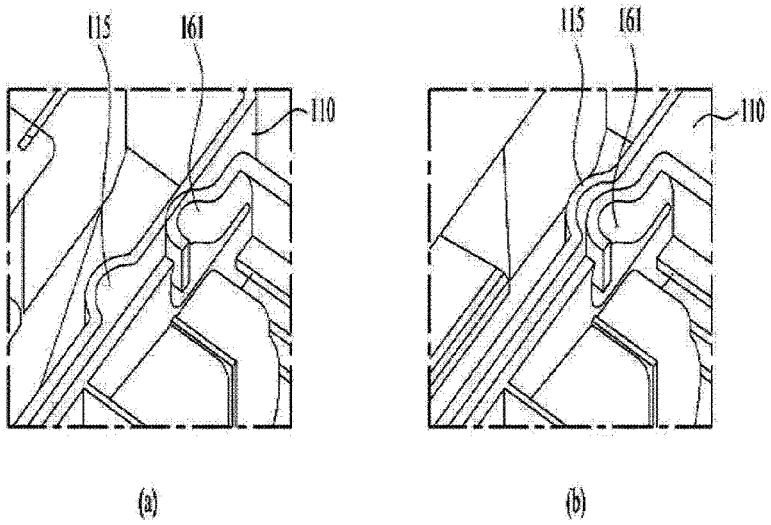

(a) and (b) of FIG. 7 show a deep-freezing portion coupled to a freezer space.

Figure 8:
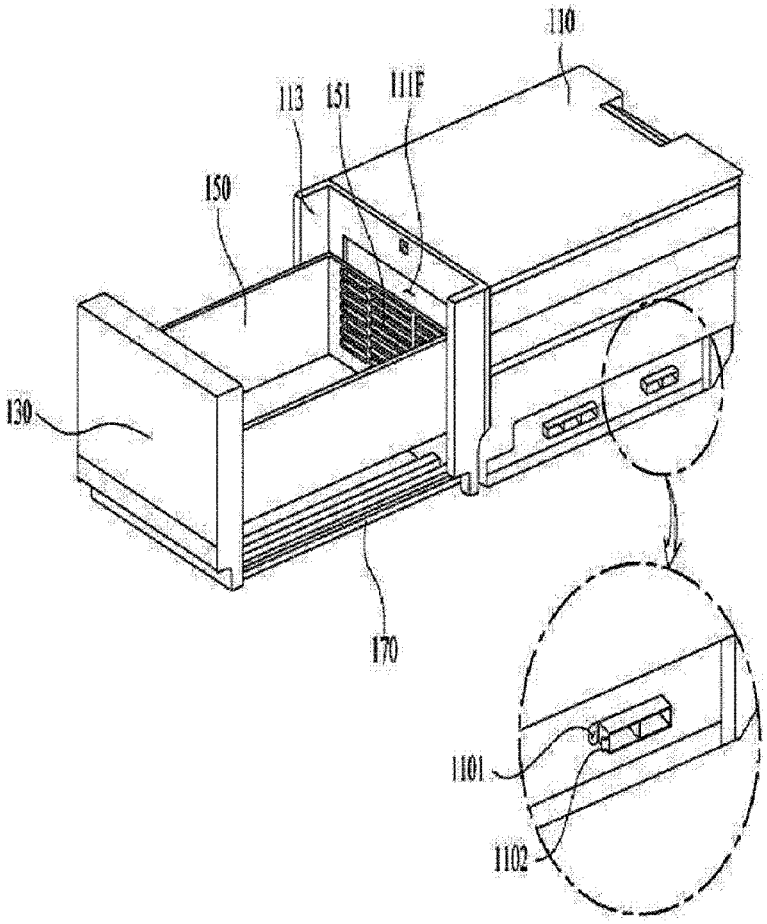
Figure 9:
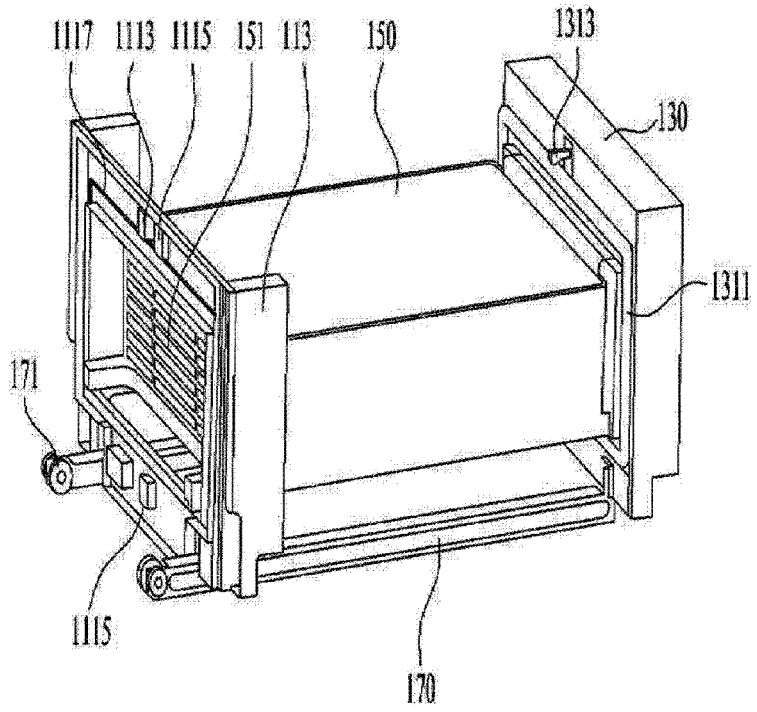

FIGS. 8 and 9 are perspective views of the deep-freezing portion in FIG. 5.

Figure 10:
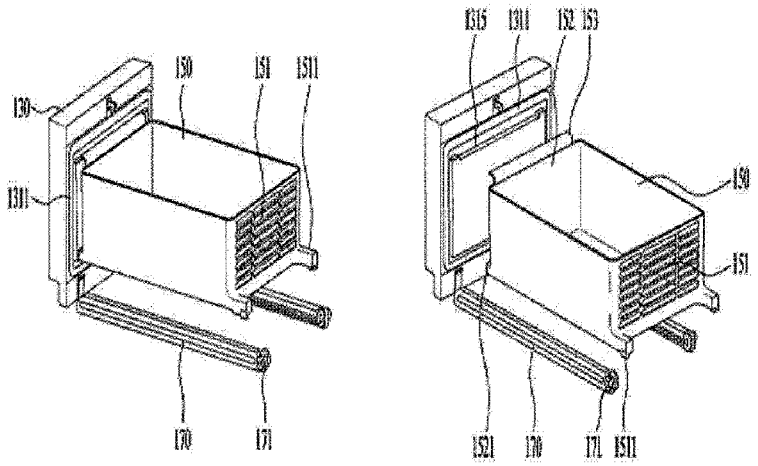
Figure 11:
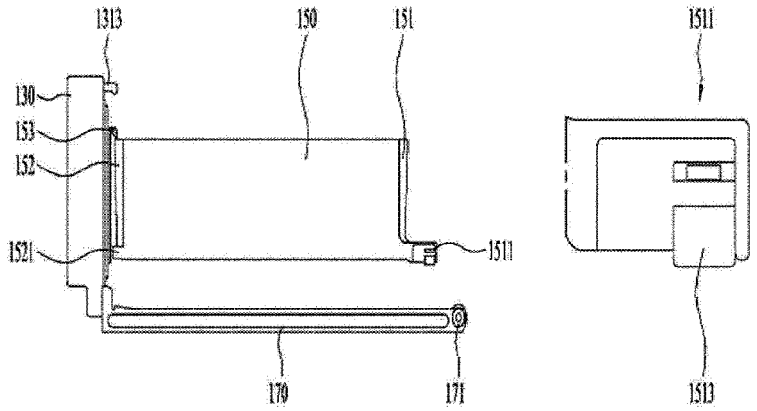

FIGS. 10 and 11 show a deep-freezing portion door and a basket.

Figure 12:
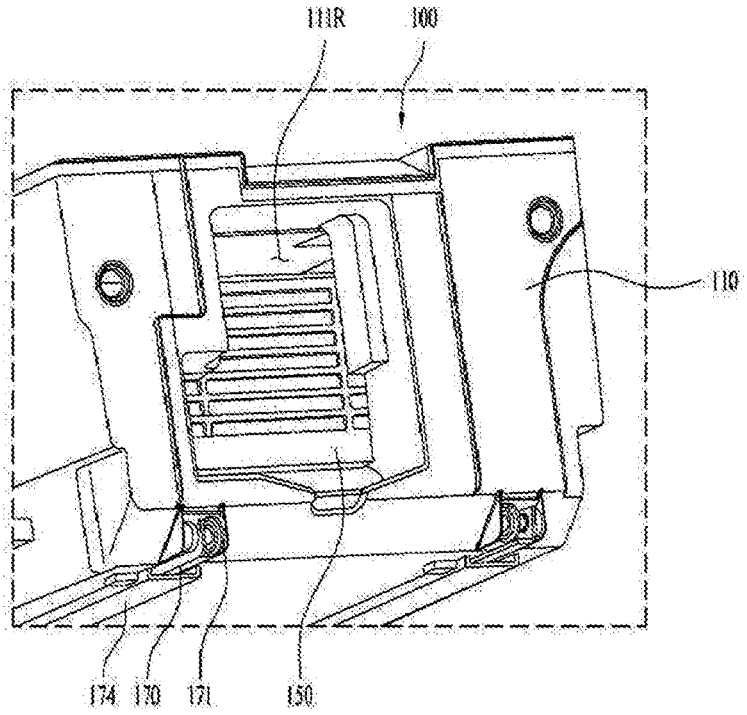

FIG. 12 is a rear perspective view of a deep-freezing portion.

Figure 13:
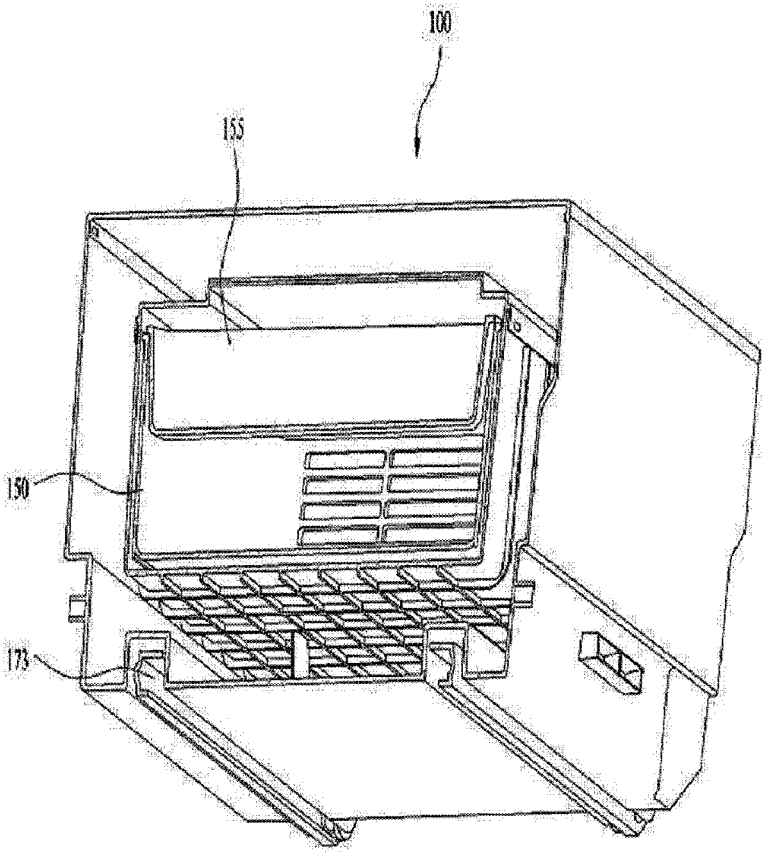

FIG. 13 is a side cross-sectional view of the deep-freezing portion in FIG. 12.

Figure 14:
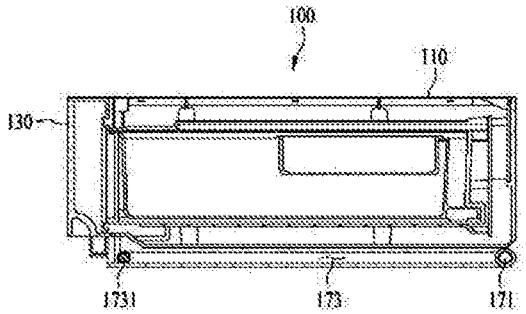
Figure 14:
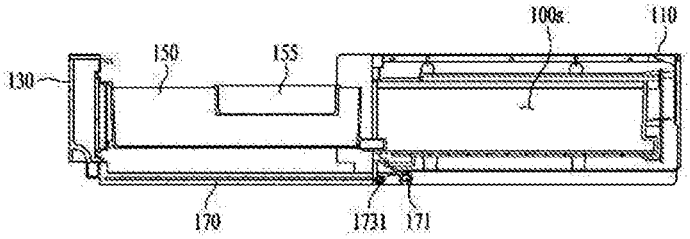

(a) and (b) of FIG. 14 show a state in which a deep-freezing portion door is inserted.

Figure 15:
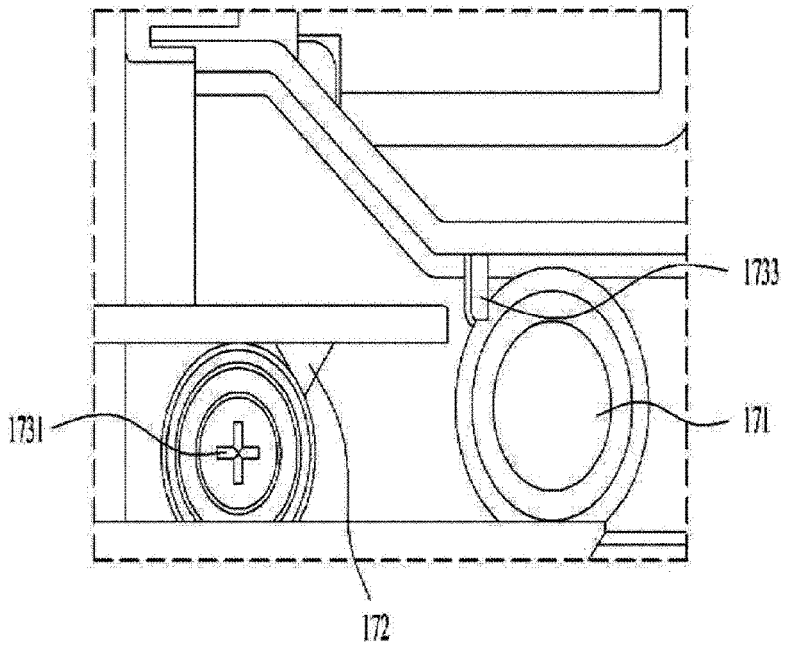

FIG. 15 shows a structure to limit a withdrawal distance of a deep-freezing portion door and a structure to prevent removal thereof.

Figure 16:
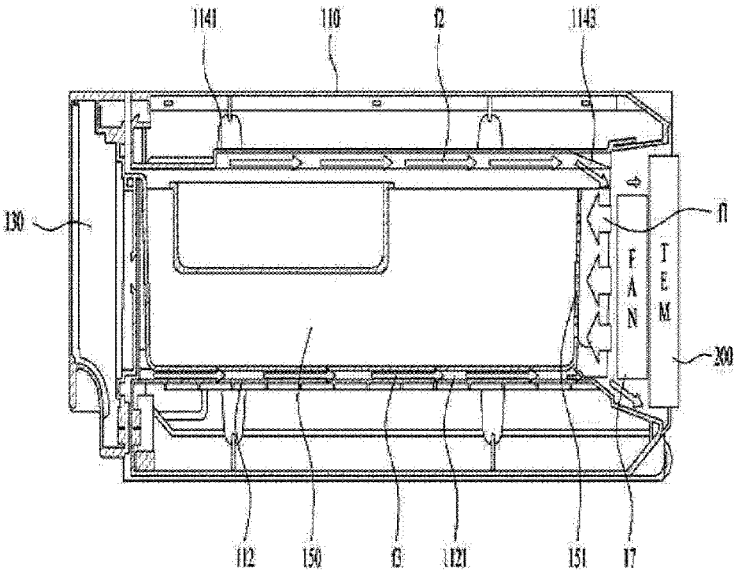

FIG. 16 is a cross-sectional view of a flow of cold air inside a deep-freezing portion.

Figure 17:
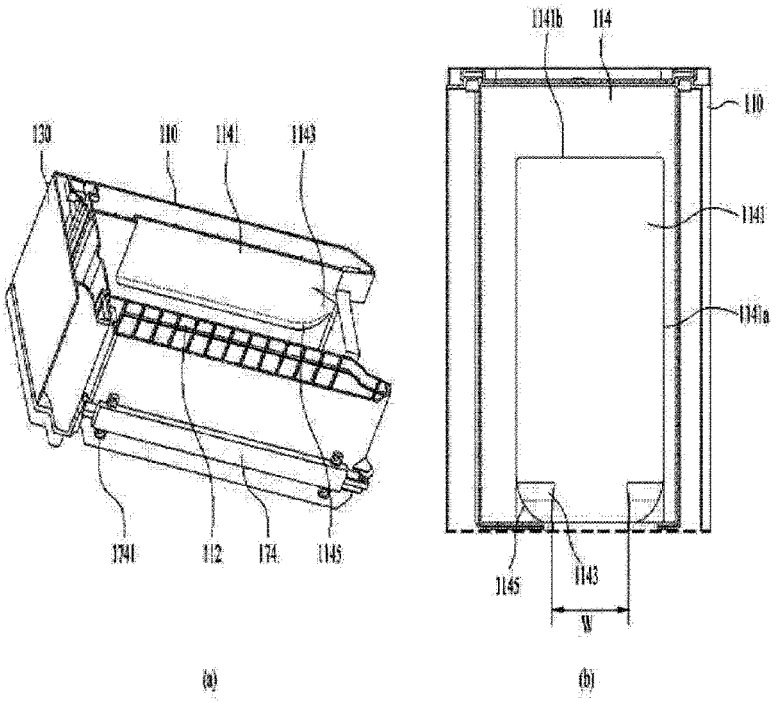

(a) of FIG. 17 is a side cross-sectional view of a deep-freezing portion and (b) of FIG. 17 is an inner top view of a deep-freezing portion.

Figure 18:
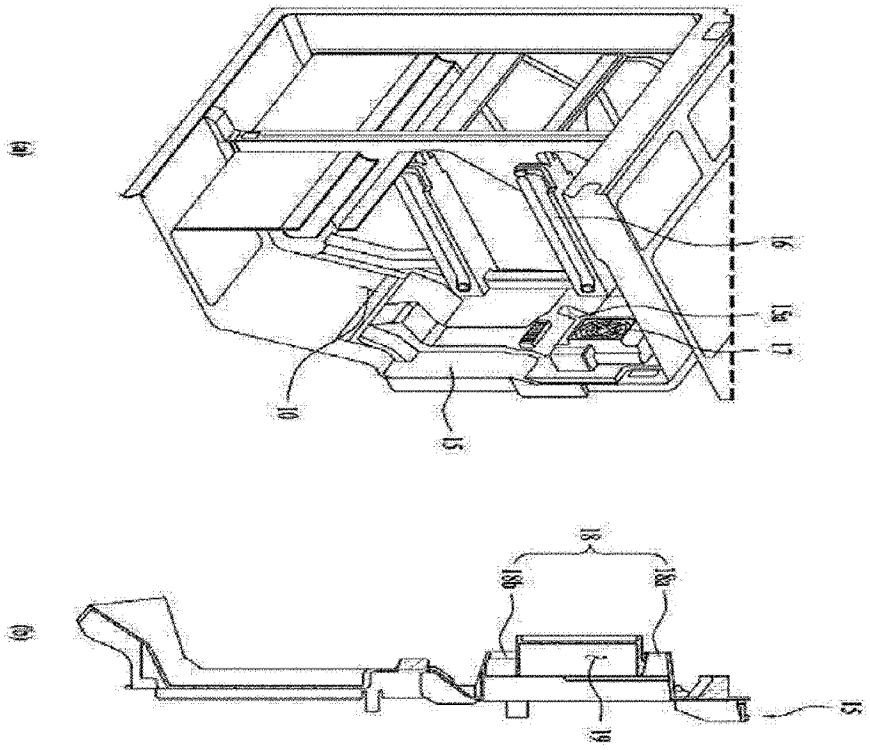

(a) of FIG. 18 is a side cross-sectional view of a freezer space and (b) of FIG. 18 is a side cross-sectional view of a grill fan assembly.

Figure 19:
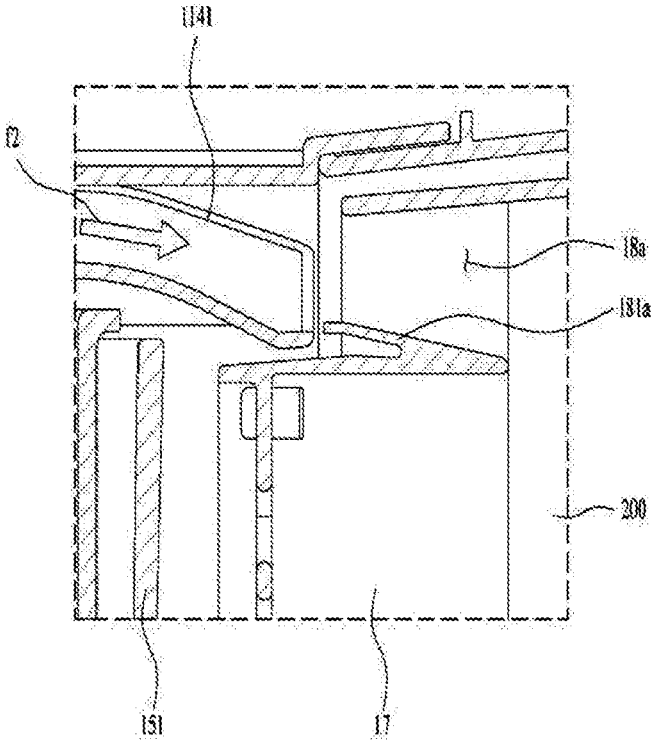

FIG. 19 is a cross-sectional view of airflow inside a deep-freezing portion.

BEST MODE

Hereinafter, specific embodiments of the present disclosure are described with reference to drawings. The following detailed description is provided to help a comprehensive understanding of a method, an apparatus, and/or a system described herein. However, this is merely an example and the present disclosure is not limited thereto.

Description of well-known technology relating to the present disclosure may be omitted if it unnecessarily obscures the gist of the present disclosure. In addition, terms described below are defined in consideration of functions in the embodiments of the present disclosure, which may vary according to intentions or customs of users and operators. Therefore, the definition should be made based on the contents throughout the specification. The terminology used in the detailed description is for the purpose of describing embodiments of the present disclosure only and is not intended to limit the disclosure. Singular expressions used in the present disclosure include plural expressions unless the context clearly indicates otherwise. In the present disclosure, terms such as "including" or "comprising" specify features, integers, steps, operations, elements, and a portion or a combination thereof, but do not preclude a presence or a possibility of one or more other features, integers, steps, operations, elements, and a portion or a combination thereof in addition to what has been described above.

In addition, terms such as first, second, A, B, (a), (b) and the like may be used herein when describing elements of the present disclosure. These terms are intended to distinguish one element from other elements, and the essence, order, or sequence of corresponding elements is not limited by these terms.

Figure 1:
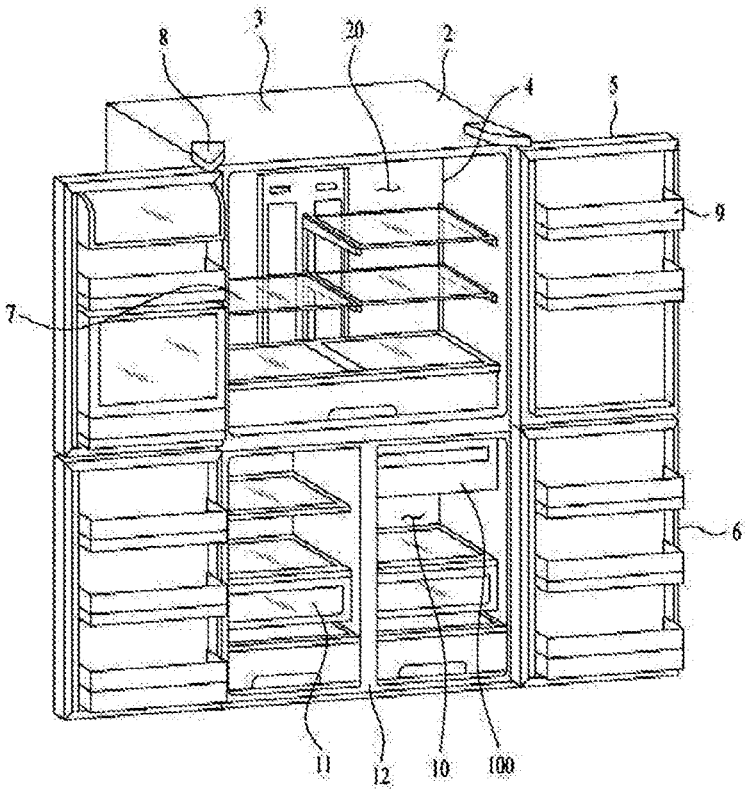
FIG. 1 shows open doors of a refrigerator according to an embodiment of the present disclosure.
Figure 2:
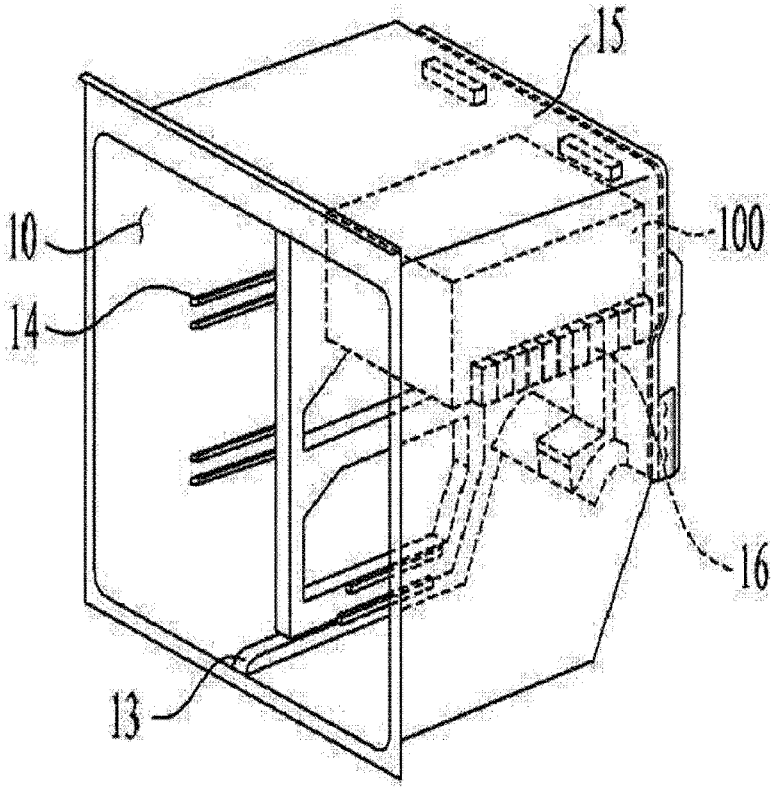
FIG. 2 shows a deep-freezing portion in FIG. 1.
Figure 3:
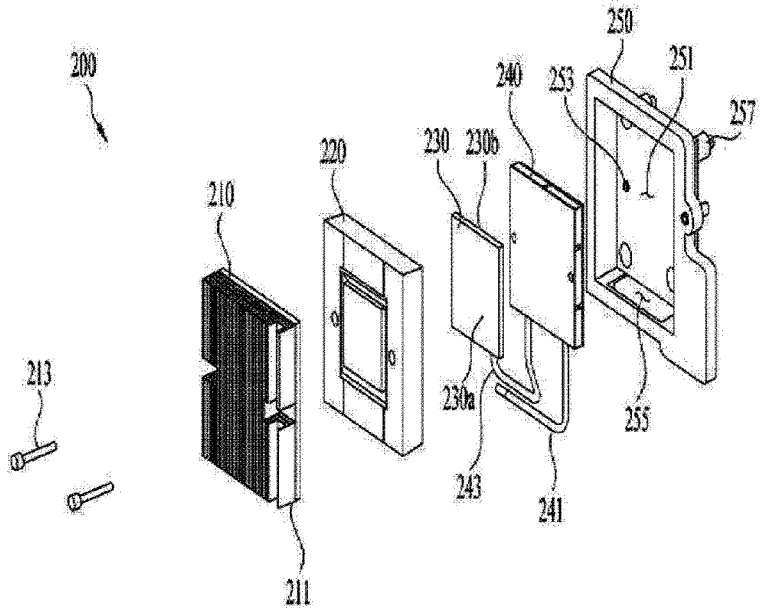
FIG. 3 shows a thermoelectric element module according to an embodiment of the present disclosure.
Figure 4:
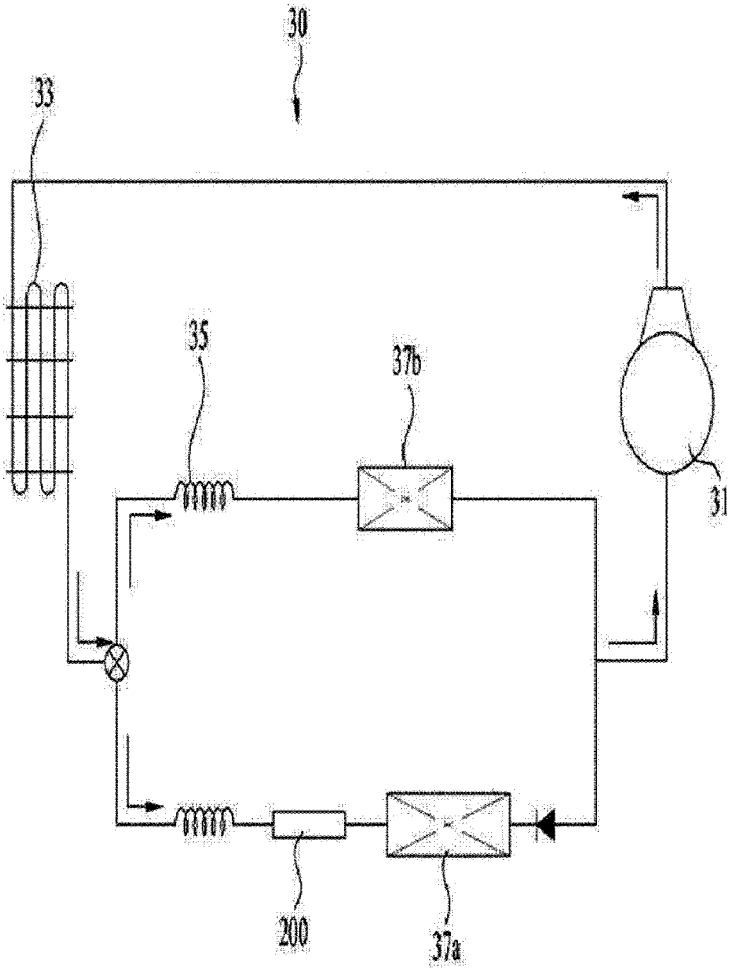
FIG. 4 shows a refrigeration cycle used in a refrigerator according to an embodiment of the present disclosure.

FIG. 1 shows open doors of a refrigerator according to an embodiment of the present disclosure. FIG. 2 shows a deep-freezing portion in FIG. 1. FIG. 3 shows a thermoelectric element module according to an embodiment of the present disclosure. FIG. 4 shows a refrigeration cycle used in a refrigerator according to an embodiment of the present disclosure.

Referring to FIGS. 1 to 4, according to an embodiment of the present disclosure, a refrigerator 1 includes a refrigerator body 2 having a rectangular shape and a refrigerator door to open and close each space of the refrigerator 1 from the front of the body 2. According to the present disclosure, the refrigerator 1 has a bottom freezer structure in which a refrigerating space 20 is defined at an upper portion thereof and a freezer space 10 is defined at a lower portion thereof. The refrigerating space 20 and the freezer space 10 each have a side-by-side type door that is opened based on rotation about a hinge 8 disposed at both ends thereof.

However, the present disclosure is not limited to the refrigerator having the bottom-freezer structure. If the refrigerator has a deep-freezing portion in the freezer space, a side-by-side type refrigerator in which the refrigerating space and a freezer space are arranged horizontally and a top mount-type refrigerator in which a freezer space is defined on the refrigerating space may be used as examples of the refrigerator.

The refrigerator body 2 includes an outer case 3 defining an outer appearance and an inner case 4 that is spaced apart from the outer case 3 by a predetermined space and defining an inner appearance of the refrigerating space 20 and the freezer space 10. The space between the outer case 3 and the inner case 4 is filled with insulating material by foaming to insulate the refrigerating space 20 and the freezer space 10 from an indoor space.

The refrigerating space 20 and the freezer space 10 accommodate a shelf 7 and a drawer 11 in storage spaces thereof to store food by increasing space utilization efficiency. The shelf 7 and the drawer 11 may be disposed in the storage spaces thereof and may be guided along rails 14 disposed at both sides thereof. As shown, the refrigerating space door 5 and the freezer space door 6 each include a door basket 9 to suitably store containers containing beverages.

According to an embodiment of the present disclosure, a deep-freezing portion 100 is disposed in the freezer space 10. The space of the freezer space 10 is divided into a left portion and a right portion for efficient use by a partition wall 12 that extends vertically and disposed at a center of the freezer space. Referring to FIG. 2, the partition wall 12 is inserted into the freezer space from a front of the cabinet and may be supported by an installation guide 13 disposed on a bottom of the refrigerator in the freezer space 10.

According to an embodiment of the present disclosure, it is exemplified that the deep-freezing portion 100 is disposed at an upper portion of the right side of the freezer space 10. However, the deep-freezing portion 100 of the present disclosure is not necessarily limited to be disposed in the freezer space. That is, the deep-freezing portion 100 according to an embodiment of the present disclosure may be disposed in the refrigerating space 20. However, if the deep-freezing portion 100 is disposed in the freezer space 10, a temperature difference between an inside of the deep-freezing portion 100 and an outside (in the atmosphere of the freezer space) of the deep-freezing portion 100 is smaller. Therefore, the freezer space 100 may advantageously include the deep-freezing portion 100 from the viewpoint of preventing leakage of cold air or heat insulation.

Meanwhile, the thermoelectric element module 200 is an assembly in which a cold sink 210, a thermoelectric module 230, a heat insulation material 220, and a heat sink 240 are stacked and accommodated in module housing 250 to form a module.

The thermoelectric module 230 uses a Peltier effect. The Peltier effect refers to a phenomenon in which, when a DC voltage is applied to both ends of two different materials, heat is absorbed at one side thereof and is emitted at the other side thereof according to a current direction.

The thermoelectric module includes n-type semiconductor material using an electron as a main carrier and p-type semiconductor material using a hole as a carrier that are alternately connected in series. An electrode is disposed on a first surface thereof to flow current from the p-type semiconductor material to the n-type semiconductor material and an electrode is disposed on a second surface thereof to flow current from the n-type semiconductor material to the p-type semiconductor material according to one of current directions. In this case, when the current is supplied in a first direction, a first surface is a heat absorbing surface and the second surface is a heating surface, and when a current is supplied in a second direction that is opposite to the first direction, the first surface is a heating surface and the second surface is a heat absorbing surface.

According to an embodiment of the present disclosure, as the thermoelectric element module 200 is inserted into a front side of the grill fan assembly 15 from a rear side thereof, is coupled to the front side of the grill fan assembly 15, and the deep-freezing portion 100 is disposed in front of the thermoelectric element module 200, heat absorption may occur at a front surface of the thermoelectric module 230, that is, a surface facing the deep-freezing portion 100 and heat generation may occur on a rear surface of the thermoelectric module, that is, a surface against the deep-freezing portion 100 or an opposite surface to a surface directing toward the deep-freezing portion 100. In addition, when the current is supplied in the first direction in which the heat absorption occurs at the surface of the thermoelectric module 230 facing the deep-freezing portion 100 and the heat generation occurs at the opposite surface thereto, the deep-freezing portion 100 may be frozen.

In an embodiment of the present disclosure, it is exemplified that the thermoelectric module 230 has a flat plate shape with the front surface and the rear surface, and the front surface thereof is the heat absorbing surface 230*a* and the rear surface thereof is the heating surface 230*b*. The DC power is supplied to the thermoelectric module 230 and causes the Peltier effect, thereby transferring a heat generated on the heat absorbing surface 230*a* of the thermoelectric module 230 to the heating surface 230*b*. Therefore, the front surface of the thermoelectric module 230 becomes a cold surface and the rear surface thereof becomes a heat generating portion. That is, it simplifies that the heat inside the deep-freezing portion 100 is discharged to an outside of the deep-freezing portion 100. Power is supplied to the thermoelectric module 230 through a conducting wire of the thermoelectric module 230.

The cold sink 210 is stacked in contact with the front surface of the thermoelectric module 230, that is, the heat absorbing surface 230*a* facing the deep-freezing portion 100. The cold sink 210 may be made of metal such as aluminum having high thermal conductivity or an alloy and includes a plurality of heat exchange fins 211 on a front surface thereof. The plurality of heat exchange fins 211 extend vertically and are spaced apart from one another in a horizontal direction. The heat exchange fin 211 preferably extends vertically and longitudinally and has a continuous shape without interruption. This shape is configured such that water which has been melted at a time of defrosting the cold sink 210 easily flows down from the cold sink in the direction of gravity along the heat exchange fin 211 having the continuous shape and that extends vertically. A distance between the heat exchange fins 211 is preferably a distance to prevent water formed between the two neighboring heat exchange fins 211 from flowing down by surface tension.

In the cold sink 210 attached to the heat absorbing surface of the thermoelectric module, air inside the deep-freezing portion 100 flows and exchanges heat. In this case, a phenomenon occurs in which food stored in the deep-freezing portion 100 is cooled and moisture with air is frozen on the surface of the cold sink 210, which is colder. To remove the frozen water, power is applied in the above-described current supply direction, that is, in a second direction opposite to the first direction. In this case, the heat absorbing surface and the heating surface of the thermoelectric element module 200 are changed to each other in contrast to the power applied in the first direction. In this case, the surface of the thermoelectric module contacting the heat sink is a heat absorbing surface and the surface contacting the cold sink 210 is a heating surface. Therefore, the water frozen on the cold sink 210 is melted and flows down in the direction of gravity, thereby occurring defrost. That is, according to the present disclosure, when dew condensation occurs on the cold sink 210 and defrost is required, defrost may occur by applying the current in the second direction opposite to the first direction, which is the direction of the current applied for deep cooling.

The heat sink 240 is stacked in contact with the rear surface of the thermoelectric module 230, that is, the heating surface 230*b* provided in a direction opposite to an arrangement direction of the deep-freezing portion 100. The heat sink 240 rapidly dissipates or discharges heat generated on the heating surface 230*b* by the Peltier effect and may include an evaporator 37 of a refrigeration cycle cooling device 30 used to cool the refrigerator. That is, when low-temperature and low-pressure liquid refrigerant that has passed through an expansion device 35 in the refrigeration cycle absorbs the heat or evaporates while absorbing the heat in the heat sink 240, the refrigerant in the refrigeration cycle absorbs or evaporates while absorbing the heat generated on the heating surface 230*b* of the thermoelectric module 230 to immediately cool the heat generated on the heating surface 230*b*.

As the above-described cold sink 210 and heat sink 240 are stacked and the thermoelectric module 230 having the flat shape is disposed between the cold sink 210 and the heat sink 240, it is necessary to isolate heat between them. Therefore, the thermoelectric element module 200 of this embodiment includes the heat insulating material 220 that surrounds a circumference of the thermoelectric module 230 and to fill a gap between the cold sink 210 and the heat sink 240. That is, an area of the cold sink 210 is larger than that of the thermoelectric module 230 and is substantially the same as the heat insulating material 220. Similarly, an area of the heat sink 240 is larger than that of the thermoelectric module 230 and is substantially the same as the heat insulating material 220.

Meanwhile, the cold sink 210 and the heat sink 240 do not need to have the same size as each other and the size of the heat sink 240 may be larger to effectively dissipate the heat.

According to this embodiment, for immediate and reliable heat dissipation from the heat sink 240, an inlet pipe 241 and an outlet pipe 243 pass through the heat sink 240 to flow the refrigerant of the refrigeration cycle cooling device 30. The refrigerant evaporates in the heat sink 240 and rapidly absorbs the heat from the heating surface of the thermoelectric module 230 as evaporation heat by defining a flow path of the refrigerant over an entire area of the heat sink 240. In addition, the module housing 250 includes a pipe through-hole 255 to pass the inlet pipe 241 and the outlet pipe 243.

That is, the heat sink 240 in this embodiment is designed to have a size sufficient to immediately absorb and discharge the heat generated by the thermoelectric module 230 and the cold sink 210 may have a smaller size than that of the heat sink 240. However, in this embodiment, heat exchange efficiency of the cold sink 210 is improved by increasing the size of the cold sink 210 considering that the cold sink 210 exchanges heat between gas and solid while the heat sink 240 exchanges heat between liquid and solid. A degree of increasing the size of the cold sink is exemplified as follows. In this embodiment, the cold sink is designed to have a size corresponding to that of the heat sink in consideration of a compact size of the thermoelectric module. However, the size of the cold sink may be larger than that of the heat sink to improve the heat exchange efficiency of the cold sink.

Meanwhile, the module housing 250 includes an accommodator 251 and a fixer 257. The accommodator 251 accommodates the cold sink 210, the thermoelectric module 230, the heat insulating material 220, and the heat sink 240 in the stacked state. The fixer 257 is disposed on an opposite surface to a surface of the module housing 250 having the accommodator 251 and couples the module housing 250 to the inner case 4. In addition, the accommodator 251 defines a fastening boss 253, and the cold sink 210, the heat insulating material 220, and the heat sink 240 each include a through-hole at a position corresponding to that of the fastening boss 253. When the fastening member 213 is coupled to the fastening boss 253 through the through-holes thereof, the cold sink 210, the thermoelectric module 230, the heat insulating material 220, and the heat sink 240 in the stacked state may be coupled to the accommodator 251.

Meanwhile, the refrigeration cycle cooling device 30 of the refrigerator according to this embodiment discharges heat from the inside of the freezer space to an outside of the refrigerator using refrigerant that circulates in a thermodynamic cycle including evaporation, compression, condensation, and expansion. A compressor 31 and a condenser 33 of the cooling device 30 are disposed in a machine room defined at a lower portion of a rear side of the freezer space 100 and isolated from the freezer space 100. A grill fan assembly 15 including a grill fan defining the rear wall of the freezer space and a shroud coupled to a rear side of the grill fan to distribute cold air in the freezer space is disposed between the freezer space and the rear wall of the inner case 4.

In addition, the evaporator 37 of the refrigeration cycle cooling device 30 is disposed in a predetermined space between the grill fan assembly 15 and the rear wall of the inner case 4. When the refrigerant inside the evaporator 37 is evaporated, the evaporating refrigerant exchanges heat with the air flowing in the inner space of the freezer space 10, and the air cooled by the heat exchange is distributed in a cold air distribution space defined by the grill fan and the shroud and flows in the freezer space 10, thereby cooling the freezer space 10.

The refrigeration cycle cooling device of the present disclosure includes an evaporator 37 to evaporate by heat exchanging liquid refrigerant in a low-pressure atmosphere with air in the cooling space (the space between the grill fan assembly and the inner housing), a compressor 31 to pressurize gaseous refrigerant vaporized by the evaporator and discharge high-temperature and high-pressure gaseous refrigerant, a condenser 33 to heat-exchange the high-temperature and high-pressure gaseous refrigerant discharged from the compressor with air outside of the refrigerator (the machine room) and condense to discharge heat, and an expansion device 35 such as a capillary tube to reduce a pressure of the refrigerant condensed by the condenser 33 in the low-temperature atmosphere. The low-temperature and low-pressure liquid refrigerant with the pressure being lowered by the expansion device 35 is introduced into the evaporator again.

According to the present disclosure, as the heat of the heat sink 240 of the thermoelectric element module 200 has to be rapidly cooled, the low-temperature and low-pressure liquid refrigerant with the pressure and the temperature being lowered through the expansion device 35 is introduced into the heat sink 240 of the thermoelectric element module 200 before the low-temperature and low-pressure liquid refrigerant is introduced into the evaporator 37.

More specifically, the compressor 31 pressurizes the high-temperature and low-pressure gaseous refrigerant to discharge the high-temperature and high-pressure gaseous refrigerant. In addition, the refrigerant generates heat in the condenser 33 and is condensed, that is, liquefied. As described above, the compressor 31 and the condenser 33 are each disposed in the machine room of the refrigerator.

Low-temperature and high-pressure liquid refrigerant liquefied by the condenser 33 passes through a device such as the expansion valve, for example, the capillary tube and flows into the evaporator 37 with the pressure being lowered. In the evaporator 37, the refrigerant is evaporated while absorbing surrounding heat. According to this embodiment, after the refrigerant passes through the condenser 33, the refrigerant is branched into a refrigerating space evaporator 37*b* or a freezer space evaporator 37*a*. In this case, the heat sink 240 of the thermoelectric element module 200 is disposed in front of the freezer space evaporator 37*a* and is disposed behind the expansion device 35 in the flow path of the refrigerant.

The deep-freezing portion 100 has to maintain a maximum temperature of minus 50 degrees Celsius. When the heating surface 230*b* of the thermoelectric module 230 maintains a cold state, the heat absorbing surface 230*a* easily maintains a colder state. Accordingly, a coldest state thereof may be maintained by disposing the heat sink 240 through which the refrigerant passes in front of the freezer space evaporator 37*a* in the flow path of refrigerant. In particular, as the heat sink 240 directly contacts the thermoelectric module 230 and absorbs heat from the thermoelectric module 230 in a conductive manner using a thermal conductor such as metal, the heating surface 230*b* of the thermoelectric module 230 may definitely be cooled.

Meanwhile, if a user does not want to cool the deep-freezing portion 100 to minus 50 degrees Celsius, but want to use it at about minus 20 degrees Celsius like a normal freezer space, the deep-freezing portion 100 may be used as a general freezer portion by not supplying a power to the thermoelectric module 230. If the power is not supplied to the thermoelectric module 230 as described above, heat absorption and heat generation do not occur in the heat sink 240 stacked on the thermoelectric module 230. Accordingly, the refrigerant passing through the heat sink 240 does not absorb heat and flows into the freezer space evaporator 37*a* in a state of liquid that is not evaporated.

Hereinafter, in this embodiment, complete opening of the freezer space door 6 refers that the door basket 9 of the freezer space door 6 is disposed outside of a front side of the freezer space 10 as shown in FIG. 1 and incomplete opening thereof refers that a portion of the door basket 9 is disposed at the front side of the freezer space 10.

In addition, in various embodiments of the disclosure described below in this document, the front of the deep-freezing portion, the front of the housing, the front of the freezer space, or in the same context, the front refer to a side facing the door of the refrigerator, and the rear of the deep-freezing portion, the rear of the housing, the rear of the freezer space, or in the same context, the rear refers to a side opposite to the front side, that is, a portion facing the refrigerator door.

In addition, some components use the same name, but the components are different from each other and are described differently throughout the specification using different reference numerals. For example, a guide rail 16 described in FIGS. 5, 6 and 12 and a guide rail 173 described in FIGS. 15 and 16 are different components and are clearly differently described through the specification as different components using the different reference numerals.

FIG. 5 shows a deep-freezing portion separated from a freezer space according to an embodiment of the present disclosure. (a) of FIG. 6 is an enlarged view of a guide rail disposed on the inner wall of a freezer space. (b) of FIG. 6 is a rear view of the deep-freezing portion in FIG. 5. (a) and (b) of FIG. 7 show a deep-freezing portion coupled to a freezer space. FIGS. 8 and 9 are perspective view of the deep-freezing portion in FIG. 5.

Referring to FIGS. 5 to 9, the refrigerator of this embodiment includes a refrigerating space 20 defining an opening at a front side thereof and a freezer space 10 partitioned from the refrigerating space 20 and defining an opening at a front side thereof, the freezer space 10 may include a deep-freezing portion 100 forming a separated additional space and disposed inside of the freezer space 10. The deep-freezing portion 100 may be detachably provided inside the freezer space 10 for maintenance.

In detail, an inner portion of the freezer space 10 may be divided by the partition wall fitted onto the installation guide 13 and the deep-freezing portion 100 may be inserted into any one of the partitioned spaces. The guide rail 16 is disposed on the inner side wall of the freezer space 10 and a guide member slidable along the guide rail 16 is disposed on the outer side wall of the housing 110. The guide member is moved along the guide rail 16 to insert and draw out the deep-freezing portion 100 into and from any one of the partitioned inner spaces of the freezer space 10.

A freezing and evaporating space may be disposed at a rear side of the freezer space 10, the refrigeration cycle cooling device 30 may be disposed in the freezing and evaporating space, and the freezing and evaporating space and the freezer space 10 may be partitioned by the grill fan assembly 15 and the inner case 4.

The grill fan assembly 15 includes a grill fan defining a rear surface of the freezer space, a shroud and a fan 17 defining a flow path to supply cold air generated in the freezing and evaporating space to the freezer space 10 and may define the rear surface of the freezer space 10. The grill fan includes an upper flow path 18*a* and a lower flow path 18*b* on and under the fan 17 to provide a flow path through which air discharged from the fan 17 and introduced into the deep-freezing portion 100 circulates inside the deep-freezing portion 100. The flow path provided inside the deep-freezing portion 100 is described below.

Meanwhile, the thermoelectric element module 200 is disposed between the shroud and the inner case 4, the fan 17 is disposed on the front surface of the thermoelectric element module 200, and the deep-freezing portion 100 is disposed on the front surface of the fan 17. Here, the front surface refers to a surface facing the inside of the freezer space 10 from the inner case 4 of the freezer space 10 and the rear surface refers to a surface facing the inner case 4 of the freezer space 10 from the inside of the freezer space 10.

That is, the fan 17 supplies, to the deep-freezing portion 100, cold air having 'deep temperature' by the thermoelectric element module 200 and may be provided separately from a fan to supply cold air to the freezer space 10.

In addition, the housing 110 defines an opening 111F opened and closed by the door 130 and an opening 111R in which the thermoelectric element module 200, the fan 17, and the like may be disposed. The opening 111F is defined on the front surface of the housing 110 and is described below as an open portion on the front surface of the housing, and the opening 111R is described below as an open portion on the rear surface of the housing.

Meanwhile, a conducting wire (L) is drawn out through one side of the housing 110 to supply power to a heating wire 1117 disposed along a circumference of the opening 111F that is open and defined on the front surface of the housing 110. As the housing 110 has a large temperature difference between an inside of the housing 110 and an outside of the housing 110, a phenomenon in which liquid freezes around the opening 111F and the deep-freezing portion door 130 may occur. The heating wire is provided to melt the frozen liquid. In addition, the deep-freezing portion 100 may be more tightly closed by supplying an induced current to a portion of the deep-freezing portion door 130 using the conducting wire (L). That is, the conducting wire (L) may supply power to a load that may be provided in the deep-freezing portion 100.

The conducting wire (L) is disposed along the guide rail 16 and may be guided together when the deep-freezing portion 100 is inserted and is drawn out along the guide rail 16. If the conducting wire (L) is caught in a gap between the housing 110 and the side surface of the freezer space 10, the deep-freezing portion 100 may be not easily inserted and drawn out, and furthermore, coating of the conducting wire (L) is peeled off, which causes malfunction and exposure to a risk of accident. Therefore, the conducting wire (L) may be guided in a groove of the guide rail 16.

Referring to the enlarged view of a side surface of a lower portion of the housing 110 in FIG. 8, a guide member protrudes from the lower portion of the housing 110, includes a hole 1101 at one side thereof, and the conducting wire (L) may be drawn out to the outside of the housing 110 through the hole 1101. To prevent the conducting wire (L) from being caught in the gap between the housing 110 and the side surface of the freezer space 10, a cover 1102 may be disposed above the hole 1101 to cover at least a portion of the hole 1101 and may be spaced apart from the hole 1101 by a predetermined distance.

Meanwhile, with respect to the structure in which the deep-freezing portion 100 is separated from the inside of the freezer space 10, the freezer space 10 defines a space with an open front side, includes the guide rail 16 that extends from a front side thereof to a rear side thereof, and the guide rail 16 may include a fixing member 161 inserted into a fitting groove 115 of the housing 110 on a rear surface of the freezer space 10.

The deep-freezing portion 100 may be disposed inside the freezer space 10 by sliding along the guide rail 16. When the deep-freezing portion 100 is disposed in the freezer space 10, the fan 17 and the thermoelectric element module 200 are each disposed behind the deep-freezing portion 100.

When the deep-freezing portion 100 is disposed in the freezer space 10, if the fan 17 and the thermoelectric element module 200 are misaligned with the opening 111R or a gap is formed, cold air introduced into the deep-freezing portion 100 may leak. Therefore, the user may check that the deep-freezing portion 100 is disposed in the freezer space 10 at a right position by physical coupling between the fitting groove 115 and the fixing member 161.

Meanwhile, the fitting groove 115 may be defined closer to the rear surface of the housing 110 and the fixing member 161 may be disposed closer to the rear surface of the freezer space 10 on the guide rail 16 to intuitively notify, to the user, that there is no gap between the rear surface of the deep-freezing portion 100 and the thermoelectric element module 200. However, the fitting groove 115 and the fixing member 161 are not limited by the positional limitations. The fitting groove 115 may be defined at a portion of the outer surface of the housing 110 and the fixing member 161 may be provided outside of a movement path of the deep-freezing portion 100 on the guide rail 16.

Accordingly, the fixing member 161 may be coupled to the fitting groove 115 when the rear surface of the deep-freezing portion 100 contacts the rear surface of the freezer space 10. In this case, the rear surface of the deep-freezing portion 100 may refer to a surface defining the opening 111R of the housing 110 and the rear surface of the freezer space 10 may refer to a surface of the grill fan assembly 15.

As described above, the front surface and the rear surface refer to the front surface opened and closed by the door in front of the freezer space with respect to the storage space of the freezer space and the rear surface facing the front surface and the standards are not interpreted differently depending on components.

The fixing member 161 is elastically supported on the guide rail 16, and when the fixing member 161 is coupled to the fitting groove 115, the fixing member 161 may be elastically deformed and then restored. The elastic deformation and restoration refers that the degree of protrusion of the fixing member 161 from the upper side of the guide rail 16 is elastically deformed, and the degree of protrusion may be restored by an elastic force when the fixing member 161 is coupled to the fitting groove 115.

In detail, the fixing member 161 has a semicircular shape with a curvature and may protrude from the upper surface of the guide rail 16 at the position close to the rear surface of the freezer space 10. A first side of the guide rail 16 may be disposed at the front surface of the freezer space 10, a second side of the guide rail 16 may be disposed at the rear surface of the freezer space 10, the guide rail 16 may extend from the front surface of the freezer space 10 to the rear surface of the freezer space 10, and the fixing member 161 may protrude from the upper surface of the second side of the guide rail 16.

If the fixing member 161 is disposed at the first side (a portion facing the front surface of the freezer space) of the guide rail 16, interference due to friction may occur when the deep-freezing portion 100 is inserted into and is drawn out from the freezer space 10. The rear surface of the deep-freezing portion 100 contacts the grill fan assembly 15 to prevent the cold air generated from the thermoelectric element module 200 from leaking into the freezer space 10. Therefore, the fixing member 161 is preferably disposed close to the rear surface of the freezer space 10.

Furthermore, the fitting groove 115 may have a shape corresponding to an outer shape of the fixing member 161 such that the fixing member 161 is in surface contact with the fitting groove 115. The fixing member 161 of this embodiment has the semicircular shape with the curvature, and accordingly, the fitting groove 115 may have a semicircular shape corresponding to the curvature.

Therefore, when the user draws out the deep-freezing portion door 130, the housing 110 may be prevented from being drawn out from the freezer space 10 by the coupling between the fixing member 161 and the fitting groove 115. When the user draws out the housing 110, the user has to pull the housing 110 by elastically deforming the protruding portion of the fixing member 161.

That is, when the user draws out the stored material from the housing 110 by pulling out the deep freezer portion door 130 to draw out the stored materials from the inside of the deep-freezing portion 100, the deep-freezing portion 100 may be fixed inside the freezer space 10.

Referring to FIG. 8, a configuration of the deep-freezing portion 100 is described. The deep-freezing portion 100 may include housing 110 defining an opening 111F at a front surface thereof and providing a deep-freeze space 100S and a deep-freezing portion door 130 slidable with respect to the housing 110 and to open and close the opening 111F defined on the front surface of the deep-freezing portion.

In more detail, a guide member 170 is disposed at a lower portion of the deep-freezing portion door 130 and is movable along a guide rail 173 of the housing 110 to slide the deep-freezing portion door 130 to the inner space of the housing 110. The configurations of the guide rail 173 and the guide member 170 are described below with reference to FIGS. 14 to 17.

As the door 6 rotates, the open front portion of the freezer space 6 may be opened and closed. Based on the opening of the front surface of the freezer space by the rotation of the door 6, the deep-freezing portion 100 is opened. The door 130 slides to the housing 110 to open and close the opening 111F of the housing. Based on the opening and closing thereof, the basket 150 may be inserted into and drawn out from the housing 110 to store or draw out food in or from the deep freezer portion 100.

Meanwhile, protrusion members 113 protrude from a front side of the opening 111F and are disposed at both sides of the deep-freezing portion door 130 to prevent shaking of the deep-freezing portion door 130 when the deep-freezing portion door 130 closes the opening in contact with the opening 111F.

That is, the deep-freezing portion door 130 has a width that is smaller than that of the housing 110 and may be less interfered with the door basket 9 disposed inside the freezer space door 6 by a difference between the width of the deep-freezing portion door 130 and the width of the housing 110 when the deep-freezing portion door 130 is drawn out.

Meanwhile, a fastener may be disposed on at least one of the deep-freezing portion door 130 or the front surface of the housing of this embodiment and may include a first fastener 1115 and a hook 1313 disposed on the front surface of the housing and the door 130, facing each other, and to provide a magnetic force, and a second fastener including a coupling groove 1113 into which the hook 1313 is inserted.

The first fastener 1115 may include a magnet having magnetism and the deep-freezing portion door 130 may open and close the front open space 111F of the housing by the magnetic force. Further, the deep-freezing portion door 130 may include the hook 1313 that protrudes toward the opening 111F defined on the front surface thereof and the hook 1313 may be inserted into the coupling groove 1113 defined at a portion of the opening 111F provided on the front surface thereof to couple the deep-freezing portion door 130 to the front surface of the housing.

As the inside of the deep-freezing portion 100 is maintained at 'deep-temperature' which is lower than that of the inside of the freezer space, it is necessary to prevent the cold air from leaking from the inside of the deep-freezing portion 100. Therefore, as described above, the deep-freezing portion door 130 may open and close the opening 111F in contact with the opening 111F. That is, the door 130 is coupled to the housing 110 by the first fastener and the second fastener using a multiple fastening structure, thereby effectively preventing the cold air from leaking from the inside of the deep-freezing portion.

Meanwhile, the first fastener 1115 may be made of material having magnetism by itself, or material having the magnetism when a current flows, and may receive a current by a conducting wire (L) drawn out to the outside of the deep-freezing portion 100. The user may adjust the magnetism based on an amount of current supply to adjust a degree of closing thereof by contacting the deep-freezing portion door 130 with the opening 111F.

In addition, the first fastener 1115 may be disposed on the deep-freezing portion door 130 or the opening 111F as described above or the first fasteners 1115 may be disposed on the deep-freezing portion door 130 and the opening 111F at positions corresponding to each other and may be coupled by an attraction force. If the first fastener 1115 is disposed only in either one of the deep-freezing portion door 130 or the opening 111F, the part where the first fastener 1115 is not disposed has to be made of material such as iron to attach to the magnet. In this case, the weight, the production cost, and the like of the deep-freezing portion 100 may be increased. Therefore, as described in the above example, when the magnets are disposed in the deep-freezing portion door 130 and the opening 111F and are coupled to each other by the attractive force, there is an advantage in that material of the deep-freezing portion door 130 or the opening 111F may be selected as an optimal material for insulation.

Meanwhile, the hook 1313 protrudes from the deep-freezing portion door 130 toward the opening 111F. The hook 1313 is elastically supported by the deep-freezing portion door 130 in the direction of gravity to elastically deform and restore the position of the hook 1313 when the hook 1313 is inserted into the coupling groove 1113.

The elastic deformation and restoration refers that, when the hook 1313 is inserted into the coupling groove 1113, the hook 1313 is moved while receiving an elastic force in an upward direction, and when the hook 1313 is coupled to the coupling groove 1113, the position of the hook 1313 is restored.

The hook 1313 may be elastically deformed and then restored as described above, or may be coupled to or uncoupled from the coupling groove 1313 by a switch and a button disposed on one side of the deep-freezing portion door 130.

Meanwhile, in addition to opening and closing of the opening 111F by the deep-freezing portion door 130 based on coupling between the hook 1313, the coupling groove 1113, and the magnet 1115, the door 130 may include a gasket 1311 along a circumference of an inner surface thereof to prevent leakage of the cold air in the deep-freezing portion 100 to outside. The hook 1313, the coupling groove 1113, and the magnet 1115 may be disposed in the area out of the circumference formed by the gasket 1311. If the hook 1313, the coupling groove 1113, and the magnet 1115 are disposed in an area overlapping with the gasket 1311, the effect of preventing the outflow of the cold air by the gasket 1311 may be significantly reduced. Therefore, as described above, the hook 1313, the coupling groove 1113, and the magnet 1115 are each preferably disposed in the area out of the circumference of the gasket 1311.

Meanwhile, a heating wire 1117 may be disposed along the circumference of the opening 111F and may receive a power from the conducting wire (L) drawn out to an outside of the deep-freezing portion 100. The housing 110 includes a hole 1101 at one side thereof and the conducting wire (L) may be drawn out to outside through the deep-freezing portion 100 via the hole 1101.

The deep-freezing portion 100 includes the hole 1101 at the lower portion thereof as described above and protruding members disposed at both sides of the lower portion of the deep-freezing portion 100 are provided in a path guided by a guide rail 16 of the freezer space. Therefore, the deep-freezing portion 100 may not interfere with the protruding members when the deep-freezing portion 100 is inserted into and is drawn out from the freezer space. In addition, a cover member 1102 may be disposed at one side of the hole 1101 and covers an upper portion of the hole 1101 to prevent an accident such as peeling off of covering of the conducting wire (L) due to caught of the conducting wire (L) between the deep-freezing portion 100 and the inner wall of the freezer space 10.

FIGS. 10 and 11 show a deep-freezing portion door and a basket.

Referring to FIGS. 10 and 11, the deep-freezing portion 100 may include a basket 150 that may be inserted into and drawn out from the deep-freezing portion 100 as the deep-freezing portion door 130 is opened and closed, the deep-freezing portion basket 150 includes a fixing member 153 that protrudes from one side of the deep-freezing portion basket 150, and the fixing member 153 may be inserted into a groove 1315 defined on an inner surface of the deep-freezing portion door 130 to couple the deep-freezing portion basket 150 to the deep-freezing portion door 130.

The fixing member 153 has various shapes such that the fixing member 153 is inserted into the groove 1315, and in this embodiment, the fixing member 153 has a hook shape.

That is, the deep-freezing portion basket 150 may be provided separately from the deep-freezing portion door 130, include a first surface 152 facing an inner surface of the deep-freezing portion door 130 and a second surface 151 facing the first surface 152 and on which the grill is placed, and the fixing member 153 may be disposed on the first surface 152.

In addition, a first support member 1521 protrudes from a lower side of the first surface 152 to contact the inner surface of the deep-freezing portion door 130 and a second support member 1511 protrudes from a lower side of the second surface 151 to contact a bottom surface 112 of the housing 110.

The fixing member 153 and the first support member 1521 each protrude from the first surface 152 of the basket 150, the fixing member 153 may be disposed on the first surface 152, and the first support member 1521 may be disposed under the first surface 152. The fixing member 153 and the first support member 1521 have a relative difference in height from the first surface 152. The first support member 1521 contacts the inner surface of the door 130 to support a rotational moment generated from the basket 150 with respect to the fixing member 153, thereby stably gripping the basket 150 on the inner surface of the door 130.

In addition, the basket 150 is detachably coupled to the door 130 and may be provided at a height spaced apart from the guide member 170 by a predetermined distance. The basket 150 is directly coupled to the inner surface of the door 130 to connect the guide member 170 to the lower side of the door 130. Therefore, the inner space of the housing 110 may be widely used.

If the basket 150 is not gripped by the door 130, the basket 150 has to be drawn out based on the opening and closing of the door 130, so the basket 150 has to be supported on the guide member 170. In this case, the guide member 170 is inevitably slidable in the inner space of the housing 110, which is an element reducing the inner space of the housing 110.

To maximize the use of the inner space of the housing 110, the guide member 170 is connected to the lower side of the door 130 and slides on the housing 110 at the outside of the inner space of the housing 110, the basket 150 has to be gripped on other configurations than the guide member 170 and may be drawn out based on the opening and closing of the door 130. Therefore, according to the configuration described in this embodiment, the basket 150 may be stably gripped on the inner surface of the door 130 at the height spaced apart from the guide member 170 by the predetermined distance.

Meanwhile, the second surface 151 may be referred to as the surface on which the grill is disposed, and the grill 151 may define an inlet through which cold air generated from the thermoelectric element module 200 disposed at the rear of the deep-freezing portion 100 is introduced.

In addition, the second support member 1511 protrudes from the lower surface of the grill 151 and contacts the bottom surface 112 of the housing 110. The housing 110 define openings 111F and 111R at the front surface and the rear surface thereof and has the bottom surface 112, an upper surface 114, and a side surface. The bottom surface 112 forms an inner bottom surface of the housing 110. The upper surface 114 forms an inner upper surface of the housing 110. The rear surface forms an inner rear surface of the housing 110 and defines an open space accommodating the fan 17 to introduce cold air of the thermoelectric element module 200 into the housing 110. The side surface extends from a front side of the housing 110 to a rear side of the housing 110 in a depth direction.

In this embodiment, the deep-freezing portion basket 150 includes the fixing member 153 disposed on the first surface 152 and inserted into the groove 1315 of the deep-freezing portion door and rotates clockwise about the contact portion between the groove 1315 and the fixing member 153. Therefore, the first support member 1521 may be disposed under the first surface 152, that is, at an opposite side to an upper side of the first surface 152 at which the fixing member 153 is disposed, protrudes toward the inner surface of the deep temperature portion door 130, and contacts the inner surface of the deep-freezing portion door 130 to fix a horizontal position of the deep-freezing portion basket 150 and firmly couple to the deep-freezing portion door 130.

In addition, the grill 151 may include a second support member 1511 that protrudes from a lower surface of the grill 151 and contacting the bottom surface 112 of the housing to prevent the deep-freezing portion basket 150 from contact with the bottom surface 112 of the housing 110 as the deep-freezing portion basket 150 is tilted as described above. In addition, a contact member 1513 is disposed in the second support member 1511 and protrudes from the support member 1511 in the direction of gravity to directly contact the bottom surface 112 of the housing.

That is, the basket 150 may include the first support member 1521 and the second support member 1511 disposed at the same height. In detail, the first support member 1521 may be disposed at the lower portion of the basket 150 to support the rotational moment generated as the fixing member 153 is disposed at the upper portion of the basket 150 and the second support member 1511 may be disposed at the lower portion of the basket 150 to prevent the basket 150 from being damaged due to the contact of the basket 150 with the bottom surface 112 of the housing 110.

Meanwhile, the contact member 1513 is additionally provided in the second support member 1511 that protrudes from the second surface 151, and for the provision, the second support member 1511 may include a groove into which the contact member 1513 is inserted. The contact member 1513 may be injection molded by a series of processes using the same material as the deep-freezing portion basket 150 by directly contacting the contact member 1513 with the bottom surface 112 of the housing, thereby simplifying a process. The contact member 1513 is made of additional material having high strength, hardness, and rigidity including POM material and may be fitted into the second support member 1511.

FIG. 12 is a rear perspective view of a deep-freezing portion. FIG. 13 is a side cross-sectional view of FIG. 12. FIG. 14 is a state view in which a deep-freezing portion door is inserted. FIG. 15 shows a structure to limit a withdrawal distance of a deep-freezing portion door and a structure to prevent removal thereof.

Referring to FIGS. 12 to 15, a deep-freezing portion 100 of this embodiment includes housing 110 defining an opening at a front side thereof and providing a deep-freeze space 100S having a predetermined length from the front side thereof to a rear side thereof, a guide rail 173 that extends from one side of the housing 110 in a longitudinal direction of the housing 110, a guide member 170 movable along the guide rail 173, and a door 130 connected to the guide member 170 to open and close the front side of the housing, and the guide rail 173 may extend longer than a length of the deep-freeze space 100S.

The deep-freeze space 100S is defined inside the housing 110, is partitioned from the inner storage space of the freezer space, and maintains a temperature lower than that of the storage space. A boundary of the deep-freeze space 100S is defined by an inner front surface, an inner rear surface, and an inner side surface of the housing 110. A length of the deep-freeze space 100S may refer to a length from the inner front surface of the housing 110 to the inner rear surface of the housing 110. In addition, as the inside of the deep-freeze space 100S is maintained at a cryogenic temperature, the housing 110 may have a predetermined thickness for thermal insulation.

In this configuration, the guide rail 173 may extend longer than the length of the deep-freeze space 100S and an extending length of the guide rail 173 may be close to a distance from an outer front surface of the housing to an outer rear surface of the housing. Referring to FIG. 12, the guide rail 173 of this embodiment may be recessed from the outer lower surface of the housing 110 along a longitudinal direction of the housing 110 (may extend from the outer front surface of the housing to the outer rear surface of the housing).

The outer front surface of the housing 110 may be described as an outer surface defining an opening 111F of the housing and the outer rear surface of the housing 110 refers the outer surface of the housing 110 in contact with a grill fan assembly 15.

Meanwhile, the deep-freezing portion door 130 is slidably provided on the guide rail 173 disposed under the housing 110 and is inserted and is drawn out based on sliding of the guide member 170 inserted into the guide rail 173. A general freezer space maintains a temperature of about 20 degrees Celsius, but the deep-freezing portion 100 of this embodiment maintains a temperature of 40 degrees Celsius or less, which is 'deep-temperature'. The guide rail 173 is disposed outside of the space where the temperature of 40 degrees Celsius or less is maintained and enables sliding of the deep-freezing portion door 130.

If the guide rail is disposed inside the housing 110, there is a fear that more cold air may leak to outside when the deep-freezing portion door 130 is opened and closed, and furthermore, freezing occurs between the guide rail and a guide, thereby degrading sliding of the deep-freezing portion door 130 and weakening durability thereof. Therefore, the guide rail 173 of this embodiment is disposed at a lower side of the outer portion of the housing 110 and the guide member 170 is connected to a lower side of the deep-freezing portion door 130 to slide the deep-freezing portion door 130.

When the guide member 170 is connected to the lower side of the deep-freezing portion door 130 as described above, the deep-freezing portion basket 150 may not be supported by the guide member 170. That is, as the inside of the deep-freezing portion 100 is maintained at 'the deep-temperature', the deep-freezing portion 100 has the thickness for internal insulation thereof. In addition, the guide rail 173 is disposed at the lower side of the outer portion of the housing 110 and the inner bottom surface 112 of the housing 110 is spaced apart from the guide rail 173 by an outer thickness of the housing 110. Therefore, the deep-freezing portion basket 150 has to be fixed at a position spaced apart from the guide member 170 by a predetermined height.

Therefore, the deep-freezing portion basket 150 may not be supported by and coupled to the guide member 170 and has to be coupled to the deep-freezing portion door 130 at the height spaced apart from the guide member 170 by the predetermined distance. For the coupling, the deep-freezing portion basket 150 includes a fixing member 153 and the deep-freezing portion door 130 includes a groove 1315 on an inner surface thereof. Also, the first support member 1521 protrudes from the first surface 152 of the deep-freezing portion basket to stably support the deep-freezing portion basket 150. In addition, a second support member 1511 may protrude from under a grill 151 to prevent wear of the deep-freezing portion basket 150 due to contact with the bottom surface 112 of the housing 110 and application of an external force to food stored in the deep-freezing portion basket 150 by friction on the deep-freezing portion basket 150.

Meanwhile, a first side of the guide member 170 is connected to the door 130, and when the door 130 closes the front opening 111F of the housing 110, a second side of the guide member 170 may be disposed behind the deep-freeze space 100S. In addition, the guide rail 173 may communication a front side thereof with a rear side thereof, and when the door 130 closes the front surface of the housing 110, the guide member 170 may protrude from a rear end of the guide rail 173.

The rear surface of the housing 110 is disposed inside a freezer space in contact with a grill fan assembly 15 defining the rear surface of the storage space of the freezer space in the freezer space. If the second side of the guide member 170 protrudes from the rear side of the guide rail 173, the door 130 may not completely close the front surface of the housing 110 due to the contact with the grill fan assembly 15.

The grill fan assembly 15 may include a recess 15*a* to accommodate the guide rail 173. A sliding movement distance of the guide member 170 is increased based on a recessed depth of the recess 15*a* and the length of the guide rail 173, thereby obtaining a longer withdrawal distance of the door 130.

That is, the guide rail 173 extends from the front side of the outer lower surface of the housing 110 to the rear side of the outer lower surface of the housing 110 to obtain the withdrawal distance of the guide member 170, and the guide member 170 extends longer than the length of the deep-freezing portion basket 150 in the longitudinal direction of the housing and may be inserted into the guide rail 173.

If a rail defines a plurality of steps such as two or three steps to obtain the withdrawal distance of the deep-freezing portion basket 150, the durability of the guide rail may be weakened. In addition, a guide rail has to be disposed under the deep-freezing portion to accommodate the rail having the plurality of steps and occupies larger volume than that of the guide rail 173 to accommodate the guide member 170 of this embodiment, thereby reducing space utilization of the deep-freeze space.

Therefore, the guide rail 173 is disposed below the housing 110 to obtain the withdrawal distance of the one-step guide member 170 in this embodiment and extends from the outer front surface of the housing 110 to the outer rear surface of the housing 110 to obtain the withdrawal distance of the deep-freezing portion door 130.

In addition, the guide member 170 includes a roller 171 at one end thereof to slide the guide member 170 inside the guide rail 173 while minimizing friction.

Meanwhile, the guide member 170 includes an engaging member 172 to limit a sliding distance of the deep-freezing portion door 130 and the guide rail 173 includes a stopper 1731 disposed at one side thereof. The sliding distance of the deep-freezing portion door 130 may be limited by contacting the engaging member 172 with the stopper 1731.

More specifically, the engaging member 172 is disposed in front of the roller 171 in the guide member 170, and the front refers to a portion toward the door 130 with respect to the housing 110 as described above. That is, a first end of the guide member 170 is connected to the door 130 and the roller 171 is disposed at a second end thereof. Therefore, the engaging member 172 may be disposed in front of the roller 171 in the guide member 170.

The stopper 1731 is disposed close to the opening 111F of the housing 110 in the guide rail 173 and the engaging member 172 may be disposed in front of the roller 171 provided at one side of the guide member 170. That is, the guide rail 173 may include the stopper 1731 at the front side of the outer lower surface of the housing 110 and the engaging member 172 may be provided at a portion of the guide member 170 that extends further from the deep-freezing portion basket 150.

When the deep-freezing portion basket 150 is removed from the deep-freezing portion door 130 and is drawn out to outside, to obtain a distance corresponding to a depth direction (a direction toward an inner space of the housing from the deep-freezing portion door) of the deep-freezing portion basket 150 in the housing 110, a sliding distance of the deep-freezing portion door 130 may be limited by contacting the engaging member 172 with the stopper 1731. If the sliding distance of the deep-freezing portion door 130 is not limited, there is a risk in that the deep-freezing portion door 130 is separated from and fall down from the housing 110.

In addition, when the engaging member 172 contacts the stopper 1731 and the deep-freezing portion door 130 is drawn out at a maximum level, a rotational moment is generated based on the withdrawal distance of the deep-freezing portion door 130. In this case, there is a risk in that the deep-freezing portion door 130 is separated from and falls down from the housing 110. The guide rail 173 further includes a rib 1733 that protrudes from one side thereof to prevent separation of the deep-freezing portion door 120 by contact with the guide member 170 when the deep-freezing portion door 120 is rotated in the direction of gravity.

In detail, the rib 1733 may be disposed at an inner portion of the guide rail 173 than the stopper 1731, and when the deep-freezing portion door 120 rotates by receiving the moment, the rib 1733 may contact the upper surface of the guide member 170. In this case, the guide member 170 may include the roller 171 at the lower portion thereof and an upper portion of the guide member 170 may extend shorter than the lower portion of the guide member 170.

That is, the guide member 170 may have a rod shape, the upper portion thereof and the lower portion thereof are spaced apart from each other by a predetermined distance and extend. The engaging member 172 is disposed at the upper side of the guide member 170 and contacts the stopper 1731 disposed between the upper side and the lower side of the guide member 170 to limit the withdrawal distance of the deep-freezing portion door 130. The lower side of the guide member 170 extends further than the upper side of the guide member 170 in the length (depth) direction of the housing 110 from the deep-freezing portion door 130 and the roller 171 may be disposed at the extending portion thereof.

In addition, the guide rail 173 may provide a slidable space of the guide member 170 under the housing 110 and support the guide member 170, or is recessed from the outer surface of the housing 110. A rail cover 174 is connected to the guide rail 173 to support the guide member 170 and may move and support the guide member 170 simultaneously.

That is, when the guide rail 173 is recessed from the lower surface of the housing and defines an opening at one side thereof, the rail cover 174 covers the open portion thereof to define a path with four surfaces, support the load of the guide member 170, and moves the guide member 170 along the guide rail 173.

If the guide rail 173 is disposed under the lower surface of the housing 110 as the path with the four surfaces, a thickness of the housing 110 is increased, thereby reducing one of the storage space in the freezer space or the deep-freeze space of the deep-freezing portion or not facilitating the injection molding during the manufacturing of the housing 110.

In addition, the housing 110 may be made of insulating material to maintain the inside thereof at the cryogenic temperature, but it is not easy to manufacture the guide rail 173 having all surfaces made of the insulating material and defining a path with the four surfaces.

Therefore, the housing 110 may be easily manufactured by disposing, under the housing 110, the guide rail 173 defining the opening at one side thereof and having the recessed shape and covering, by the rail cover 174, the open portion of the guide rail 173.

In addition, the rail cover 174 includes a fixer 1741. The fixer 1741 may couple the rail cover 174 to the housing 110 and may include various shapes such that the rail cover 174 is coupled to the housing 110.

Meanwhile, as described above, the rail cover 174 is connected to the guide rail 173 to form the path through which the guide member 170 may move and in which a front side thereof communicates with a rear side thereof. When the door 130 closes the front opening 111F of the housing 110, the second end of the guide member 170 may be disposed behind the rear end of the rail cover 174. Therefore, the rail cover 174 does not need to have a length corresponding to that of the guide rail 173 and may have a length shorter than that of the guide rail 173.

Meanwhile, the deep-freezing portion basket 150 may define a space to store food and include an additional shelf 155 to partition the storage space inside the deep freezer space basket 150.

FIG. 16 is a cross-sectional view of a flow of cold air inside a deep-freezing portion. (a) of FIG. 17 is a side cross-sectional view of a deep-freezing portion. (b) of FIG. 17 is an inner top view of a deep-freezing portion. (a) of FIG. 18 is a side cross-sectional view of a freezer space. (b) of FIG. 18 is a side cross-sectional view of a grill fan assembly. FIG. 19 is a cross-sectional view of air flow inside a deep-freezing portion.

Referring to FIGS. 16 to 19, a thermoelectric element module 200 of this embodiment includes a thermoelectric module 230 having a heat absorbing surface 230*a* and a heating surface 230*b*. In addition, a fan 17 faces the heat absorbing surface 230*a* of the thermoelectric module and introduces cold air into the deep-freezing portion 100. An accommodator 19 accommodates the fan 17, protrudes from an inner surface of the freezer space and includes a guide 18 disposed at one side of the accommodator 19 and to guide flow of the cold air. The housing 110 provides a flow path 1141 defined at a portion of an inner surface of the housing and stepped from the inner surface of the housing.

The guide 18 may include an upper path 18*a* defined at an upper portion of the accommodator 19 and a lower path 18*b* defined at a lower portion of the accommodator 19.

As described above, the housing 110 defines the openings 111F and 111R on the front surface and the rear surface, respectively, and an inner space of the housing 110 may include a bottom surface 112 facing a lower side of the deep-freezing portion basket 150 and defining the bottom surface of the housing 110, an upper surface 114 facing the bottom surface 112, and side surfaces connecting the upper surface 114, the bottom surface 112, a front surface, and a rear surface to divide the inner space thereof to have a cube shape.

In addition, the upper surface 114 of the housing 110 may define a stepped flow path 1141 at a portion thereof. The flow path 1141 may extend in direction of expanding the deep-freeze space 110S in the housing 110. Specifically, the flow path 1141 has a recess shape and is concaved upward from a portion of an upper surface 114 of the housing 110 to expand the deep-freeze space 110S.

The flow path 1141 includes vertical portions 1141*a* having a width of the flow path and spaced apart from each other, and that extends in a longitudinal direction of the deep-freezing portion and a horizontal portion 1141*b* connecting one sides of the vertical portions. The flow path 1141 may be defined on the upper surface 114 and may have a U-shape.

The vertical portion 1141*a* may extend in a direction of decreasing the width of the flow path 1141 along the longitudinal direction of the deep-freezing portion. In this case, the width between one sides of the vertical portions 1141*a* corresponds to a length of the horizontal portion 114*b* and a width (W) of second sides of the vertical portions 1141*a* may be shorter than that of the horizontal portion 1141*b*.

According to an embodiment of the present disclosure, the vertical portion 1141*a* with the width of the flow path 1141 may have a shape as described in an embodiment in (b) of FIG. 17. Specifically, the width of the flow path 1141 is maintained constantly in a certain section in the longitudinal direction of the deep-freezing portion (in a direction from a side of the vertical portion 1141*a* to a second side of the vertical portion 1141*a*) and is decreased at a portion defining the second side of the vertical portion 1141*a*.

In addition, the second side of the vertical portion 1141*a* may communicate with the guide 18 and the width (W) between the second sides of the vertical portions 1141*a* may be the same as the guide 18.

In addition, the flow path 1141 may be inclined downward from the upper surface 114 of the housing toward the rear surface of the housing.

That is, the cold air introduced into the housing 110 through the flow path 1141 having the various shapes may be guided toward the guide 18 and may be discharged to the outside of the housing 110.

Meanwhile, the vertical portions 1141*a* extend in parallel while maintaining the width of the horizontal portion 1141*b* at one side thereof and then extend in a direction of decreasing the width of the vertical portions at a predetermined area of the second side of the vertical portion 1141*a*. A bending portion 1145 may decrease the width of the vertical portions. The flow path 1141 may have inclination at the bending portion 1145. The step of the flow path 1141 defines a flow path through which cold air flows inside the housing. The bending portion 1145 and an inclined portion 1143 may be disposed at the second side of the vertical portion 1141*a* to obtain an area of the flow path and guide the cold air to the guide 18.

Meanwhile, the deep-freezing portion basket 150 is spaced apart from the bottom surface 112 by a predetermined height and a second flow path 1121 may be defined in a space between the bottom surface 112 and the basket 150. When the flow paths are respectively defined on the upper surface 114 and the bottom surface 112 of the housing 110 as described above, the flow path 1141 defined on the upper surface of the housing refers to a first flow path.

A height of the basket 150 is smaller than that of the housing 110 and the basket 150 may be coupled to the inner surface of the door 130 at a position spaced apart from each of the upper surface 114 and the bottom surface 112 of the housing.

The movement path of cold air by the above configuration is described. The cold air is introduced into the housing by a thermoelectric module and a fan accommodated in the accommodator 19 and the introduced cold air passes through a grill disposed on the rear surface of the basket 150. That is, the cold air moves from the rear surface of the housing 110 to the front surface of the housing and a flow of the cold air from the front surface of the housing 110 to the rear surface of the housing 110 is divided into an upper flow of the housing 110 and a lower flow of the housing 110 at the front surface thereof.

In detail, referring to FIG. 16, a flow (f1) of cold air flowing into the housing through the thermoelectric element module and the fan directs the front surface of the housing from the rear surface of the housing, and the flow circulating to the rear surface of the housing from the front surface of the housing may be divided into a flow (f2) guided along the first flow path 1141 of the housing and a flow (f3) guided along the second flow path 1121.

The first flow path 1141 communicates with the upper flow path 18*a*, may provide a space sufficient to move the cold air by the horizontal portion 1141*b* and the vertical portion 1141*a* as described above and may easily introduce the cold air to the upper flow path 18*a* by the bending portion 1145 and the inclined portion 1143.

Meanwhile, the upper flow path 18*a* may include a guide inclined portion 181*a* to guide flow of the cold air to minimize an element that may act as a resistance to the flow of the cold air moving along the bending portion 1145 and the inclined portion 1143. The guide inclined portion 181*a* may be inclined downward from the lower portion of the upper flow path 18*a* along the flow path through which the cold air moves and may prevent interruption of flow that may occur at the communication portion between the first flow path 1141 and the upper flow path 18*a*.

The second flow path 1121 communicates with the lower flow path 18*b*. In this case, the second flow path 1121 and the lower flow path 18*b* do not form a step. Preferably, the second flow path 1121 and the lower flow path 18*b* may form a parallel surface and communicate with each other. That is, a height of the lower flow path 18*b* may correspond to a height between the lower surface of the basket 150 and the bottom surface 112.

In addition, the flow path and the guide communicate with each other when the housing 110 is coupled to the inner side of the freezer space, that is, when the accommodator 19 is inserted into and coupled to the opening 111R defined on the rear surface of the housing 110.

Meanwhile, as the bending portion 1145 is defined at the second side of the vertical portion 1141*a* and is bent in the direction of decreasing the width of the first flow path 1141, the inclined portion 1143 may be defined radially along the boundary surface of the bending portion 1145. Even in this case, a width (W) determined by the bending portions 1145 has to correspond to the width of the upper flow path 18*a*.

Hereinabove, representative embodiments of the present disclosure are described. However, a person having ordinary knowledge in the art to which the present disclosure pertains will understand that various modifications can be made to the above-described embodiments within the scope that does not deviate from the scope of the present disclosure. Therefore, the scope of the present disclosure should not be limited to the described embodiments, but should be defined based on claims described below and equivalents to the claims.

| Description of Symbols | | |
|---|---|---|
| 1: Refrigerator | 2: Body | 3: Outer case |
| 4: Inner case | 5: Refrigerating space door | 6: Freezer space door |
| 7: Shelf | 8: Hinge | 9: Door basket |
| 10: Freezer space | 11: Drawer | 12: Partition wall |
| 13: Installation guide | 14: Rail | 15: Grill fan assembly |
| 16: Guide rail | 17: Fan | 18a: Upper flow path |
| 18b: Lower flow path | 19: Accommodator | 20: Refrigerating space |
| 30: Cooling device | 31: Compressor | 33: Condenser |
| 35: Expansion device | 37: Evaporator | |
| 100: Deep-freezing portion | 110: Housing | |
| 130: Deep-freezing portion door | | 150: Deep-freezing portion basket |
| 170: Guide | 200: Thermoelectric element module | |

The invention claimed is:

1. A refrigerator, comprising:

a freezer space that defines a storage space;

a deep-freezing portion disposed in the freezer space and defining a deep-freeze space that is partitioned from the storage space;

a thermoelectric element module comprising (i) a thermoelectric module that has a heat absorbing surface and (ii) a heating surface, wherein the thermoelectric element module is configured to generate cold air;

a fan facing the heat absorbing surface of the thermoelectric module and configured to introduce the cold air into the deep-freezing portion; and an accommodator that accommodates the fan, the accommodator protruding from an inner surface of the freezer space, wherein the deep-freezing portion comprises:

a housing that has an opening at a front surface thereof and an opening at a rear surface thereof to receive the accommodator, and defines an inner space of the deep-freezing portion, and a door configured to open and close the front surface of the housing, wherein the accommodator comprises a guide disposed at one side of the accommodator and configured to guide flow of the cold air, wherein the housing comprises a flow path defined at a portion of an inner surface of the housing and configured to flow cold air introduced into the deep-freezing portion by the fan, wherein the flow path comprises a recessed portion recessed in the inner surface of the housing and extending along the deep-freeze space, and wherein a width of the recessed portion is (i) decreased along a longitudinal direction of the deep-freezing portion or (ii) constant in a first section along the longitudinal direction of the deep-freezing portion and then decreased along a second section along the longitudinal direction of the deep-freezing portion.

2. The refrigerator of claim 1, wherein the recessed portion is recessed in an upper surface of the inner surface of the housing.

3. The refrigerator of claim 1, wherein the recessed portion comprises:

a plurality of vertical portions that have the width of the recessed portion, wherein the plurality of vertical portions are spaced apart from each other, and extend along the longitudinal direction of the deep-freezing portion; and a horizontal portion connecting the vertical portions at a first side of the plurality of vertical portions.

4. The refrigerator of claim 3, wherein a second side of the plurality of vertical portions is configured to communicate with the guide, a width of the second side of the plurality of vertical portions being equal to a width of the guide.

5. The refrigerator of claim 1, wherein the recessed portion is inclined downward from an upper surface of the housing towards a rear surface of the housing.

6. The refrigerator of claim 5, wherein the recessed portion comprises:

a plurality of vertical portions that have the width of the recessed portion, wherein the plurality of vertical portions are spaced apart from each other, and extend along the longitudinal direction of the deep-freezing portion; and a horizontal portion connecting the plurality of vertical portions at a first side of the vertical portion.

7. The refrigerator of claim 6, wherein the recessed portion further comprises a bending portion that extends along a section wherein the width of the recessed portion decreases along the longitudinal direction of the deep-freezing portion and is disposed at a second side of the plurality of vertical portions.

8. The refrigerator of claim 7, wherein the recessed portion is inclined downward towards the rear surface of the housing at the bending portion.

9. The refrigerator of claim 7, wherein the bending portion extends from the vertical portion towards a position corresponding to a width of the guide.

10. The refrigerator of claim 1, wherein the deep-freezing portion further comprises a basket coupled to the door and configured to, based on the door opening and closing the front surface of the housing, be drawn out to an outside of the deep-freezing portion, wherein the flow path further comprises:

a space defined between a portion of the inner surface of the housing and the basket, wherein the recessed portion and the space are configured to flow cold air introduced into the deep-freezing portion by the fan, and wherein the recessed portion is configured to, based on the accommodator being inserted into the opening at the rear surface, communicate with the guide.

11. The refrigerator of claim 10, wherein the space is defined between a bottom surface of the inner surface of the housing and the basket, and wherein the recessed portion is recessed in an upper surface of the inner surface of the housing and extends along the deep-freeze space.

12. The refrigerator of claim 11, wherein the recessed portion comprises:

a plurality of vertical portions having a width of the recessed portion, wherein the plurality of vertical portions are spaced apart from each other, and extend along the longitudinal direction of the deep-freezing portion;

a horizontal portion connecting the plurality of vertical portions at one side of the plurality of vertical portions; and a bending portion that extends from a second side of the plurality of vertical portions along a direction wherein the width of the recessed portion decreases.

13. The refrigerator of claim 11, wherein a height of the basket is less than a height of the housing, and wherein the basket is coupled to an inner surface of the door and is spaced apart from each of the upper surface and a lower surface of the inner surface of the housing by a predetermined distance.

14. The refrigerator of claim 12, wherein the recessed portion further comprises an inclined portion that is inclined downward from the upper surface of the housing toward the rear surface of the housing, and wherein the inclined portion is disposed at the recessed portion along the bending portion.

15. The refrigerator of claim 10, wherein the guide comprises an upper flow path that is configured to communicate with the recessed portion, and wherein the upper flow path comprises a guide inclined portion and the guide inclined portion is inclined downward from a lower portion of the upper flow path along the flow path through which the cold air moves.

* * * * *